US012509946B1

(12) United States Patent
Mukhopadhyay

(10) Patent No.: US 12,509,946 B1
(45) **Date of Patent: *Dec. 30, 2025**

(54) POLYCRYSTALLINE DIAMOND COMPACTS INCLUDING A CEMENTED CARBIDE SUBSTRATE

(71) Applicant: US Synthetic Corporation, Orem, UT (US)

(72) Inventor: Debkumar Mukhopadhyay, Sandy, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/761,846

(22) Filed: Jul. 2, 2024

Related U.S. Application Data

(60) Continuation of application No. 18/129,362, filed on Mar. 31, 2023, now Pat. No. 12,054,992, which is a (Continued)

(51) Int. Cl.
*E21B 10/00* (2006.01)
*E21B 10/42* (2006.01)

(Continued)

(52) U.S. Cl.
CPC ..... *E21B 10/5735* (2013.01); *E21B 10/42* (2013.01); *E21B 10/55* (2013.01); *E21B 10/567* (2013.01)

(58) Field of Classification Search
CPC ..... E21B 10/5735; E21B 10/42; E21B 10/55; E21B 10/567

(Continued)

(56) References Cited

U.S. PATENT DOCUMENTS 4,268,276 A 5/1981 Bovenkerk
4,311,490 A 1/1982 Bovenkerk et al.

(Continued)

OTHER PUBLICATIONS

Corrected Notice of Allowance for U.S. Appl. No. 15/911,825 mailed Feb. 11, 2020.

(Continued)

*Primary Examiner* — James E McDonough
(74) *Attorney, Agent, or Firm* — Ballard Spahr LLP

(57) ABSTRACT

Embodiments relate to a polycrystalline diamond compact ("PDC") including a polycrystalline diamond ("PCD") table bonded to a cemented carbide substrate including tungsten carbide grains having a fine average grain size to provide one or more of enhanced wear resistance, corrosion resistance, or erosion resistance, and a PDC with enhanced impact resistance. In an embodiment, a PDC includes a cemented carbide substrate having a cobalt-containing cementing constituent cementing tungsten carbide grains together exhibiting an average grain size of about 1.5 μm or less. The substrate includes an interfacial surface and a depletion zone depleted of the cementing constituent that extends inwardly from the interfacial surface to a depth of, for example, about 30 μm to about 60 μm. The PDC includes a PCD table bonded to the interfacial surface of the substrate. The PCD table includes diamond grains bonded together exhibiting an average grain size of about 40 μm or less.

20 Claims, 11 Drawing Sheets

Related U.S. Application Data continuation of application No. 16/789,825, filed on Feb. 13, 2020, now Pat. No. 11,661,798, which is a division of application No. 15/648,742, filed on Jul. 13, 2017, now Pat. No. 10,612,313, which is a division of application No. 13/954,545, filed on Jul. 30, 2013, now Pat. No. 9,732,563.

(60) Provisional application No. 61/768,812, filed on Feb. 25, 2013.

(51) Int. Cl.
*E21B 10/55* (2006.01)
*E21B 10/567* (2006.01)
*E21B 10/573* (2006.01)

(58) Field of Classification Search
USPC ..... 175/432
See application file for complete search history.

(56) References Cited

U.S. PATENT DOCUMENTS

| | | | | |
|---|---|---|---|---|
| 4,410,054 | A | 10/1983 | Nagel et al. | |
| 4,468,138 | A | 8/1984 | Nagel | |
| 4,560,014 | A | 12/1985 | Geczy | |
| 4,604,106 | A | 8/1986 | Hall et al. | |
| 4,738,322 | A | 4/1988 | Hall et al. | |
| 4,811,801 | A | 3/1989 | Salesky et al. | |
| 4,913,247 | A | 4/1990 | Jones | |
| 5,016,718 | A | 5/1991 | Tandberg | |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 5,820,985 | A | 10/1998 | Horton et al. | |
| 6,338,754 | B1 | 1/2002 | Cannon et al. | |
| 6,793,681 | B1 | 9/2004 | Pope et al. | |
| 7,866,418 | B2 | 1/2011 | Bertagnolli et al. | |
| 8,236,074 | B1 | 8/2012 | Bertagnolli et al. | |
| 8,297,382 | B2 | 10/2012 | Bertagnolli et al. | |
| 8,727,046 | B2 | 5/2014 | Miess et al. | |
| 8,734,552 | B1 | 5/2014 | Vail et al. | |
| 9,316,059 | B1 | 4/2016 | Topham et al. | |
| 9,732,563 | B1 | 8/2017 | Mukhopadhyay | |
| 9,938,775 | B1 | 4/2018 | Topham et al. | |
| 10,030,451 | B1 | 7/2018 | Mukhopadhyay et al. | |
| 10,584,539 | B1 | 3/2020 | Topham et al. | |
| 10,612,313 | B1 | 4/2020 | Mukhopadhyay | |
| 11,035,176 | B1 | 6/2021 | Topham et al. | |
| 11,661,798 | B1 * | 5/2023 | Mukhopadhyay .... | E21B 10/567 51/297 |
| 2004/0140132 | A1 | 7/2004 | Middlemiss | |
| 2005/0210755 | A1 | 9/2005 | Cho et al. | |
| 2006/0191723 | A1 | 8/2006 | Keshavan | |
| 2010/0022424 | A1 | 1/2010 | Vogt et al. | |
| 2010/0126779 | A1 | 5/2010 | Corbett et al. | |
| 2010/0200305 | A1 | 8/2010 | Griffin et al. | |
| 2010/0212971 | A1 | 8/2010 | Mukhopadhyay et al. | |
| 2010/0294571 | A1 * | 11/2010 | Belnap ..... | E21B 10/55 423/446 |
| 2011/0031032 | A1 | 2/2011 | Mourik et al. | |
| 2011/0031033 | A1 | 2/2011 | Mourik et al. | |
| 2011/0067929 | A1 | 3/2011 | Mukhopadhyay et al. | |
| 2012/0012401 | A1 | 1/2012 | Gonzalez et al. | |
| 2012/0031675 | A1 | 2/2012 | Truemner et al. | |
| 2012/0241226 | A1 | 9/2012 | Bertagnolli et al. | |
| 2013/0299249 | A1 | 11/2013 | Weaver et al. | |
| 2015/0246427 | A1 | 9/2015 | Can | |

OTHER PUBLICATIONS

Corrected Notice of Allowance for U.S. Appl. No. 16/017,657 mailed Nov. 12, 2019.
Final Office Action for U.S. Appl. No. 13/590,840 mailed Jun. 23, 2015.
Final Office Action for U.S. Appl. No. 13/590,840 mailed Sep. 11, 2015.
Final Office Action for U.S. Appl. No. 13/954,545 mailed Jan. 10, 2017.
Final Office Action for U.S. Appl. No. 14/539,015 mailed Oct. 19, 2017.
Final Office Action for U.S. Appl. No. 15/648,742 mailed Aug. 2, 2019.
Issue Notification for U.S. Appl. No. 13/590,840 mailed Mar. 30, 2016.
Issue Notification for U.S. Appl. No. 13/954,545 mailed Jul. 26, 2017.
Issue Notification for U.S. Appl. No. 14/539,015 mailed Jul. 4, 2018.
Issue Notification for U.S. Appl. No. 15/078,904 mailed Mar. 21, 2018.
Issue Notification for U.S. Appl. No. 15/648,742 mailed Mar. 18, 2020.
Issue Notification for U.S. Appl. No. 15/911,825 mailed Feb. 19, 2020.
Issue Notification for U.S. Appl. No. 16/017,657 mailed Nov. 13, 2019.
Issue Notification for U.S. Appl. No. 16/585,639 mailed Aug. 16, 2023.
Issue Notification for U.S. Appl. No. 17/323,537 mailed Aug. 23, 2023.
Issue Notification for U.S. Appl. No. 16/748,262 mailed May 26, 2021.
Non-Final Office Action for U.S. Appl. No. 13/590,840 mailed Feb. 3, 2015.
Non-Final Office Action for U.S. Appl. No. 13/954,545 mailed Aug. 12, 2016.
Non-Final Office Action for U.S. Appl. No. 14/539,015 mailed Apr. 5, 2017.
Non-Final Office Action for U.S. Appl. No. 15/078,904 mailed Jul. 26, 2017.
Non-Final Office Action for U.S. Appl. No. 15/648,742 mailed Mar. 22, 2019.
Non-Final Office Action for U.S. Appl. No. 15/911,825 mailed May 8, 2019.
Non-Final Office Action for U.S. Appl. No. 16/585,639 mailed Apr. 11, 2022.
Non-Final Office Action for U.S. Appl. No. 16/748,262 mailed Nov. 10, 2020.
Non-Final Office Action for U.S. Appl. No. 16/789,825 mailed Jul. 7, 2022.
Non-Final Office Action for U.S. Appl. No. 17/323,537 mailed Dec. 6, 2022.
Non-Final Office Action for U.S. Appl. No. 18/129,362 mailed Sep. 14, 2023.
Notice of Allowance for U,S. U.S. Appl. No. 18/129,362 mailed Dec. 22, 2023.
Notice of Allowance for U.S. Appl. No. 13/590,840 mailed Dec. 16, 2015.
Notice of Allowance for U.S. Appl. No. 13/954,545 mailed Apr. 13, 2017.
Notice of Allowance for U.S. Appl. No. 14/539,015 mailed Mar. 26, 2018.
Notice of Allowance for U.S. Appl. No. 15/078,904 mailed Dec. 6, 2017.
Notice of Allowance for U.S. Appl. No. 15/648,742 mailed Nov. 21, 2019.
Notice of Allowance for U.S. Appl. No. 15/911,825 mailed Oct. 22, 2019.
Notice of Allowance for U.S. Appl. No. 16/017,657 mailed Jun. 26, 2019.

(56) References Cited

OTHER PUBLICATIONS

Notice of Allowance for U.S. Appl. No. 16/585,639 mailed Mar. 24, 2023.
Notice of Allowance for U.S. Appl. No. 16/585,639 mailed Nov. 21, 2022.
Notice of Allowance for U.S. Appl. No. 16/748,262 mailed Feb. 18, 2021.
Notice of Allowance for U.S. Appl. No. 16/789,825 mailed Jan. 9, 2023.
Notice of Allowance for U.S. Appl. No. 17/323,537 mailed May 3, 2023.
Notice of Allowance for U.S. Appl. No. 18/129,362 mailed Apr. 10, 2024.
Restriction Requirement for U.S. Appl. No. 13/590,840 mailed Nov. 4, 2014.
Restriction Requirement for U.S. Appl. No. 13/954,545 mailed Apr. 7, 2016.
Restriction Requirement for U.S. Appl. No. 15/648,742 mailed Dec. 18, 2018.
Supplemental Notice of Allowance for U.S. Appl. No. 16/585,639 mailed Jul. 20, 2023.
Supplemental Notice of Allowance for U.S. Appl. No. 17/323,537 mailed Aug. 9, 2023.
U.S. Appl. No. 12/185,457, filed Aug. 4, 2008.
U.S. Appl. No. 13/324,237, filed Dec. 13, 2011.
U.S. Appl. No. 13/590,840, filed Aug. 21, 2012.
U.S. Appl. No. 13/795,027, filed Mar. 12, 2013.
U.S. Appl. No. 13/954,545, filed Jul. 30, 2013.
U.S. Appl. No. 14/081,960, filed Nov. 15, 2013.
U.S. Appl. No. 14/539,015, filed Nov. 12, 2014.
U.S. Appl. No. 15/078,904, filed Mar. 23, 2016.
U.S. Appl. No. 15/648,742, filed Jul. 13, 2017.
U.S. Appl. No. 16/017,657, filed Jun. 25, 2018.
U.S. Appl. No. 16/585,639, filed Sep. 27, 2019.
U.S. Appl. No. 18/129,362, filed Mar. 31, 2023.
U.S. Appl. No. 18/209,756, filed Jun. 14, 2023.
U.S. Appl. No. 61/727,841, filed Nov. 19, 2012.
U.S. Appl. No. 61/768,812, filed Feb. 25, 2013.
"Standard Test Mehtod for Determination of Coercivity (Hcs) of Cemented Carbides", ASTM B887-03 , 2008.
"Standard Test Method for Determination of Magnetic Saturation (Ms) of Cemented Carbides", ASTM B886-03 , 2008.
Rousse , et al. , "Structure of the intermediate phase of PbTe at high pressue", Physical Review B, Condensed Matter and Materials Physics, 71 , 2005 , 224116-1-224116-6.

* cited by examiner

POLYCRYSTALLINE DIAMOND COMPACTS INCLUDING A CEMENTED CARBIDE SUBSTRATE

CROSS-REFERENCE TO RELATED APPLICATIONS

This application is a continuation application of U.S. patent application Ser. No. 18/129,362 filed on Mar. 31, 2023, which is a continuation application of U.S. patent application Ser. No. 16/789,825 filed on Feb. 13, 2020, which is a division of U.S. patent application Ser. No. 15/648,742 filed on 13 Jul. 2017, which is a division of U.S. patent application Ser. No. 13/954,545 filed on 30 Jul. 2013 (now issued as U.S. Pat. No. 9,732,563), which claims priority to U.S. Provisional Application No. 61/768,812 filed on 25 Feb. 2013. The disclosure of each of the foregoing applications is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process that sinters diamond particles under diamond-stable conditions. The PDC cutting element may also be brazed directly into a preformed pocket, socket, or other receptacle formed in a bit body. The substrate may optionally be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In a conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

SUMMARY

Embodiments of the invention relate to a PDC including a PCD table that is bonded to a cemented carbide substrate including tungsten carbide grains having a relatively fine average grain size. Such a configuration may provide a substrate having one or more of enhanced wear resistance, corrosion resistance, enhanced braze cracking resistance, or enhanced erosion resistance, and a PDC with enhanced impact resistance.

In an embodiment, a PDC includes a cemented carbide substrate having a cobalt-containing cementing constituent cementing a plurality of tungsten carbide grains together that exhibit an average grain size of about 1.5 μm or less (e.g., about 0.8 μm to about 1.5 μm). The cemented carbide substrate includes an interfacial surface and a depletion zone depleted of the cobalt-containing cementing constituent that extends inwardly from the interfacial surface to a depth. The PDC includes a PCD table bonded to the interfacial surface of the cemented carbide substrate. The PCD table includes a plurality of diamond grains bonded together and defining a plurality of interstitial regions, with the plurality of the diamond grains exhibiting an average grain size of about 40 μm or less (e.g., about 30 μm or less). At least a portion of the PCD table includes a metallic constituent disposed in at least a portion of the plurality of interstitial regions.

In an embodiment, the depth of the depletion zone is about 30 μm to about 60 μm. In an embodiment, the cemented carbide substrate includes an interfacial surface that is substantially free of abnormal grain growth. In an embodiment, the depletion zone of the cemented carbide substrate exhibits a Palmquist fracture toughness of about 6 $MPa \cdot m^{0.5}$ to about 9 $MPa \cdot m^{0.5}$. In an embodiment, the average grain size of the plurality of diamond grains may be about 20 μm or less. In an embodiment, the metallic constituent of the at least a portion of the polycrystalline diamond table is present in an amount of about 7.5 weight % or less, and the at least a portion of the polycrystalline diamond table exhibits a coercivity of about 130 Oe to about 160 Oe and a specific magnetic saturation of about 5 $G \cdot cm^3/g$ to about 15 $G \cdot cm^3/g$.

In an embodiment, a method of fabricating a PDC is disclosed. The method includes providing a cemented carbide substrate including a cobalt-containing cementing constituent cementing a plurality of tungsten carbide grains together that exhibit an average grain size of about 1.5 μm or less (e.g., about 0.8 μm to about 1.5 μm). The method also includes forming an assembly including the cemented carbide substrate and a plurality of diamond particles having an average particle size of about 30 μm or less. The method further includes subjecting the assembly to an HPHT process effective to sinter the plurality of diamond particles and form a PCD table that bonds to an interfacial surface of the cemented carbide substrate. The cemented carbide substrate exhibits a depletion zone that extends inwardly from the interfacial surface to a depth of about 30 μm to about 60 μm after the cemented carbide substrate is bonded to the PCD table.

In an embodiment, a method of fabricating a PDC is disclosed. The method includes providing a cemented carbide substrate including a cobalt-containing cementing constituent cementing a plurality of tungsten carbide grains together that exhibit an average grain size of about 1.5 μm or less (e.g., about 0.8 μm to about 1.5 μm). The method also includes forming an assembly including the cemented carbide substrate and an at least partially leached PCD table having an average grain size of about 30 μm or less. The method further includes subjecting the assembly to an HPHT process effective to bond the at least partially leached PCD table to an interfacial surface of the cemented carbide substrate. The cemented carbide substrate exhibits a depletion zone that extends inwardly from the interfacial surface to a depth of about 30 μm to about 60 μm after the cemented carbide substrate is bonded to the at least partially leached PCD table.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. For example, the cemented carbide substrate of any PDC disclosed herein may exhibit any combination of values/ranges disclosed herein for average grain size of the tungsten carbide grains, amount of the cobalt-containing cementing constituent, transverse rupture strength, hardness, coercivity, magnetic saturation, depletion zone and bulk Palmquist fracture toughness, and depletion zone concentration profile in combination with the PCD table exhibiting any combination of values/ranges for average diamond grain size, amount of the metallic constituent in the PCD table, coercivity, magnetic saturation, and $G_{ratio}$.

In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

FIG. 4BB is a scanning electron photomicrograph of the depletion zone in a cobalt-cemented tungsten carbide substrate of a PDC formed by HPHT sintering diamond particles on the cobalt-cemented tungsten carbide substrate having an average tungsten carbide grain size of about 3 μm and about 13 weight % cobalt and about 87 weight % tungsten carbide.

DETAILED DESCRIPTION

Embodiments of the invention relate to a PDC including a PCD table that is bonded to a cemented carbide substrate including tungsten carbide grains having a relatively fine average grain size. Such a configuration may provide a substrate having one or more of enhanced wear resistance, corrosion resistance, enhanced braze cracking resistance, or enhanced erosion resistance, and a PDC with enhanced impact resistance. The inventor currently believes that the impact resistance of the disclosed PDCs is enhanced due to a relatively lower amount of cobalt depleted from a depletion zone and/or a more gradual depletion zone compared to a standard PDC using a relatively coarse sized cemented tungsten carbide substrate. Such a configuration may optionally exhibit to a higher Palmquist fracture toughness in the depletion zone in the PDCs according to embodiments of the invention. The inventor also currently believes that the relatively fine average grain size of the tungsten carbide grains in the cemented carbide substrate limits physical access to the cobalt-containing cementing constituent by diamond particles during HPHT sintering to thereby reduce or substantially reduce and/or eliminate abnormal grain growth of tungsten carbide grains at the interfacial surface of the cemented carbide substrate. The PDCs disclosed herein may be used in a variety of applications, such as rotary drill bits, bearing apparatuses, wire-drawing dies, machining equipment, and other articles and apparatuses.

Figure 1A:
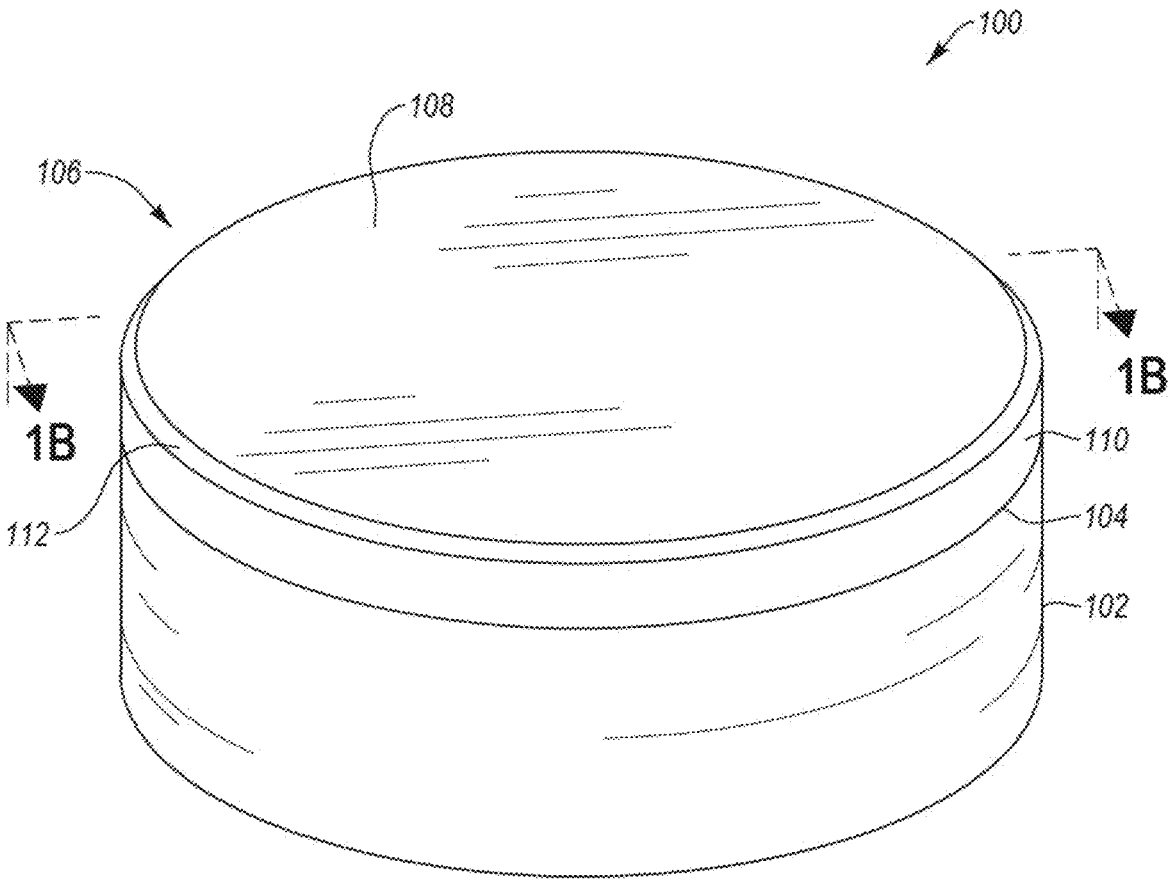
FIG. 1A is an isometric view of an embodiment of a PDC.
Figure 1B:
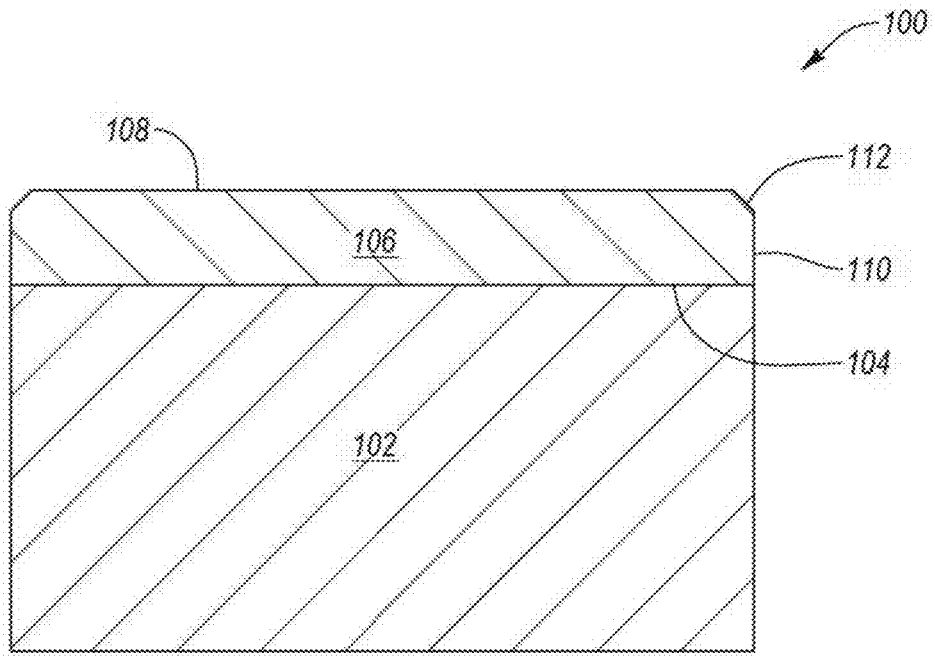
FIG. 1B is a cross-sectional view of the PDC shown in FIG. 1A taken along line 1B-1B thereof.

FIGS. 1A and 1B are isometric and cross-sectional views, respectively, of a PDC 100 according to an embodiment. The PDC 100 includes a cemented carbide substrate 102 including at least tungsten carbide grains cemented with a cobalt-containing cementing constituent. The cemented carbide substrate 102 includes an interfacial surface 104. In the illustrated embodiment, the interfacial surface 104 is substantially planar. However, in other embodiments, the interfacial surface 104 may exhibit a nonplanar topography.

The PDC 100 further includes a PCD table 106 bonded to the interfacial surface 104 of the cemented carbide substrate 102. The PCD table 106 includes a plurality of directly bonded-together diamond grains exhibiting diamond-to-diamond bonding therebetween (e.g., $sp^3$ bonding). The plurality of directly bonded-together diamond grains defines a plurality of interstitial regions. Some or substantially all of the plurality of interstitial regions may be occupied by a metallic constituent, such as a metal-solvent catalyst or a metallic infiltrant, such as cobalt, iron, nickel, or alloys thereof.

In an embodiment, the PCD table 106 may be integrally formed with (i.e., formed from diamond powder sintered on) the cemented carbide substrate 102. In another embodiment, the PCD table 106 may be a preformed (i.e., a preformed PCD table) in a first HPHT process and subsequently bonded to the cemented carbide substrate 102 in a second HPHT bonding process.

As will be discussed in more detail below, in some embodiments, the metallic constituent disposed in at least a portion of the interstitial regions may be infiltrated primarily from the cemented carbide substrate 102. In other embodiments, the metallic constituent may be provided from another source, such as disc of the metallic constituent.

The PCD table 106 includes a working, upper surface 108, at least one lateral surface 110, and an optional chamfer 112 extending therebetween. However, it is noted that all or part of the at least one lateral surface 110 and/or the chamfer 112 may also function as a working surface. In the illustrated embodiment, the PDC 100 has a cylindrical geometry, and the upper surface 108 exhibits a substantially planar geometry. However, in other embodiments, the PDC 100 may exhibit a non-cylindrical geometry and/or the upper surface 108 of the PCD table 106 may be nonplanar, such as convex or concave.

As previously discussed, the cemented carbide substrate 102 includes relatively fine tungsten carbide grains that may impart enhanced wear resistance and/or toughness to the cemented carbide substrate 102. The cemented carbide substrate 102 includes a cobalt-containing cementing constituent that cements a plurality of tungsten carbide grains together. For example, the cobalt-containing cementing constituent may be a cobalt alloy having tungsten and carbon dissolved therein from the tungsten carbide grains. The plurality of tungsten carbide grains exhibits an average grain size of about 2.5 μm or less, about 1.5 μm or less, about 1.4 μm or less, about 1.2 μm or less, about 0.5 μm to about 2.5 μm, 0.5 μm to about 2 μm, 0.8 μm to about 1.3 μm, 0.8 μm to about 1.5 μm, about 1.0 μm to about 1.5 μm, about 1.2 μm to about 1.4 μm, or about 1.2 μm. The cobalt-containing cementing constituent may be present in the cemented carbide substrate 102 in an amount of about 10 weight % to about 16 weight %, about 10 weight % to about 15 weight %, such as about 12 weight % to about 14 weight % or about 13 weight %.

The cemented carbide substrate may exhibit a transverse rupture strength of about 460 ksi to about 550 ksi (e.g., about 490 ksi to about 550 ksi, about 500 ksi to about 540 ksi, about 510 ksi to about 530 ksi about 515 ksi to about 540 ksi, or about 520 ksi to about 530 ksi) along with a hardness of about 89.5 HRa to about 92 HRa (e.g., about 90 HRa to about 92 HRa, or about 90.5 HRa). The cemented carbide substrate 102 may also exhibit a coercivity of about 130 Oe to about 250 Oe (e.g., about 140 Oe to about 220 Oe, about 160 Oe to about 220 Oe, or about 180 Oe to about 200 Oe) along with a magnetic saturation of about 85% to 95% (e.g., about 87 to about 95%) prior to HPHT processing. After HPHT processing when bonded to the PCD table 106 in the form of the PDC 100, the cemented carbide substrate 102 may exhibit a coercivity of about 130 Oe to about 150 Oe (e.g., about 135 Oe to about 145 Oe, or about 140 Oe) along with a magnetic saturation of about 10 $G \cdot cm^3/g$ to about 20 $G \cdot cm^3/g$, such as about 13 $G \cdot cm^3/g$ to about 16 $G \cdot cm^3/g$, or about 15.5 $G \cdot cm^3/g$.

In an embodiment, the cemented carbide substrate 102 includes about 13 weight % cobalt, with the balance substantially being tungsten carbide gains having an average grain size of about 1.4 μm or less such as about 1.2 μm, about 1.3 μm or less, or about 1.4 μm or less. In another embodiment, the cemented carbide substrate 102 includes about 12 weight % cobalt, with the balance substantially being tungsten carbide gains having an average grain size of about 2 μm or less, such as about 2 μm.

It should be noted that cemented carbide substrate 102 may also include other carbides in addition to tungsten carbide grains. For example, the cemented carbide substrate 102 may include chromium carbide grains, vanadium carbide, nickel carbide, tantalum carbide grains, tantalum carbide-tungsten carbide solid solution grains, or any combination thereof. Such additional carbides may be present in the cemented carbide substrate 102 in an amount ranging from about 0.05 weight % to about 10 weight %, such as 1 weight % to about 10 weight %, 1 weight % to about 3 weight %, about 0.050 weight % to about 0.50 weight %, about 0.050 weight % to about 0.15 weight %, about 0.050 weight % to about 0.10 weight %, about 0.50 weight % to about 1.00 weight %, or about 1.0 weight % to about 2.0 weight %.

In some embodiments, the PCD table 106 may be fabricated using HPHT conditions in which a sintering cell pressure is at least about 7.5 GPa so that the PCD table 106 so formed includes a relatively high amount of diamond-to-diamond bonding, a relatively small diamond grain size, and a relatively small amount of the metallic constituent incorporated therein. For example, U.S. Pat. No. 7,866,418 discloses suitable high-pressure sintering techniques that may be combined with the cemented carbide substrates disclosed herein. U.S. Pat. No. 7,866,418 is incorporated herein, in its entirety, by this reference. When the PCD table 106 is fabricated in such a manner, the very high wear resistance of the PCD table 106 may result in the cemented carbide substrate 102 prematurely preferentially wearing away or eroding away during use. It is believed that the cemented carbide substrate 102 including the relatively fine tungsten carbide grain size, as discussed above, enhances its wear resistance, erosion resistance, toughness, corrosion resistance, or combinations thereof.

According to various embodiments, the PCD table 106 sintered at a cell pressure of at least about 7.5 GPa may exhibit a coercivity of 115 Oersteds ("Oe") or more, a high-degree of diamond-to-diamond bonding, a specific magnetic saturation of about 15 Gauss ("G")$\cdot cm^3/g$ or less, and a metallic constituent content of about 7.5 weight % or less. The PCD table 106 includes a plurality of diamond grains directly bonded together via diamond-to-diamond bonding that defines a plurality of interstitial regions. At least a portion of the interstitial regions or, in some embodiments, substantially all of the interstitial regions may be occupied by the metallic constituent, such as iron, nickel, cobalt, or alloys of any of the foregoing metals.

The diamond grains may exhibit an average grain size of about 50 μm or less, such as about 40 μm or less, about 30 μm or less, about 20 μm or less, or about 20 μm to about 30 μm. For example, the average grain size of the diamond grains may be about 10 μm to about 18 μm, about 20 μm to about 30 μm, or about 15 μm to about 18 μm. In some embodiments, the average grain size of the diamond grains may be about 10 μm or less, such as about 2 μm to about 5 μm or submicron. The diamond grain size distribution of the diamond grains may exhibit a single mode, or may be a bimodal or greater grain size distribution.

In some embodiments, the metallic constituent that occupies the interstitial regions may be present in the PCD table 106 in an amount of about 7.5 weight % or less. In some embodiments, the metallic constituent may be present in the PCD table 106 in an amount of about 1 weight % to about 7.5 weight %, such as about 3 weight % to about 7.5 weight % or 3 weight % to about 6 weight %. These relatively low concentrations may be achieved by using the relatively high sintering cell pressures discussed above. In other embodiments, the metallic constituent content may be present in the PCD table 106 in an amount less than about 3 weight %, such as about 1 weight % to about 3 weight % or a residual amount to about 1 weight %. By maintaining the metallic constituent content below about 7.5 weight %, the PCD table 106 may exhibit a desirable level of thermal stability suitable for subterranean drilling applications.

Many physical characteristics of the PCD table 106 may be determined by measuring certain magnetic properties of the PCD table 106 because the metallic constituent may be ferromagnetic. The amount of the PCD table 106 present in the PCD table 106 may be correlated with the measured specific magnetic saturation of the PCD table 106. A relatively larger specific magnetic saturation indicates relatively more metal-solvent catalyst in the PCD table 106.

The mean free path between neighboring diamond grains of the PCD table 106 may be correlated with the measured coercivity of the PCD table 106. A relatively large coercivity indicates a relatively smaller mean free path. The mean free path is representative of the average distance between neighboring diamond grains of the PCD table 106, and thus may be indicative of the extent of diamond-to-diamond bonding in the PCD table 106. A relatively smaller mean free path, in well-sintered PCD table 106, may indicate relatively more diamond-to-diamond bonding.

As merely one example, ASTM B886-03 (2008) provides a suitable standard for measuring the specific magnetic saturation and ASTM B887-03 (2008) e1 provides a suitable standard for measuring the coercivity of the PCD. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pennsylvania) is one suitable instrument that may be used to measure the specific magnetic saturation and the coercivity of the PCD.

Generally, as the sintering pressure that is used to form the PCD table 106 increases, the coercivity may increase and the magnetic saturation may decrease. The PCD table 106 defined collectively by the bonded diamond grains and the metallic constituent may exhibit a coercivity of about 115 Oe or more and a metallic constituent content of less than about 7.5 weight % as indicated by a specific magnetic saturation of about 15 $G\cdot cm^3/g$ or less. In an embodiment, the coercivity of the PCD table 106 may be about 115 Oe to about 250 Oe and the specific magnetic saturation of the PCD may be greater than 0 $G\cdot cm^3/g$ to about 15 $G\cdot cm^3/g$. In an embodiment, the coercivity of the PCD table 106 may be about 155 Oe to about 175 Oe and the specific magnetic saturation of the PCD may be greater than 0 $G\cdot cm^3/g$ to about 15 $G\cdot cm^3/g$. In an embodiment, the coercivity of the PCD table 106 may be about 115 Oe to about 175 Oe and the specific magnetic saturation of the PCD table 106 may be about 5 $G\cdot cm^3/g$ to about 15 $G\cdot cm^3/g$. In an embodiment, the coercivity of the PCD table 106 may be about 155 Oe to about 175 Oe and the specific magnetic saturation of the PCD table 106 may be about 10 $G\cdot cm^3/g$ to about 15 $G\cdot cm^3/g$. In an embodiment, the coercivity of the PCD table 106 may be about 130 Oe to about 160 Oe and the specific magnetic saturation of the PCD table 106 may be about 10 $G\cdot cm^3/g$ to about 15 $G\cdot cm^3/g$. The specific permeability (i.e., the ratio of specific magnetic saturation to coercivity) of the PCD may be about 0.10 $G\cdot cm^3/g\cdot Oe$ or less, such as about 0.060 $G\cdot cm^3/g\cdot Oe$ to about 0.090 $G\cdot cm^3/g\cdot Oe$. In some embodiments, despite the average grain size of the bonded diamond grains being less than about 30 μm, the metallic constituent content in the PCD table 106 may be less than about 7.5 weight % (e.g., about 3 weight % to about 7.5 weight % or 3 weight % to about 6 weight %), resulting in a desirable thermal stability.

Generally, as the sintering cell pressure is increased above 7.5 GPa, a wear resistance of the PCD table 106 so-formed may increase. For example, the $G_{ratio}$ may be at least about $4.0\times10^6$, such as about $5.0\times10^6$ to about $15.0\times10^6$ or, more particularly, about $8.0\times10^6$ to about $15.0\times10^6$. In some embodiments, the $G_{ratio}$ may be at least about $30.0\times10^6$. The $G_{ratio}$ is the ratio of the volume of workpiece cut to the volume of PCD table 106 worn away during the cutting process. An example of suitable parameters that may be used to determine a $G_{ratio}$ of the PCD table 106 are a depth of cut for the PCD cutting element of about 0.254 mm, a back rake angle for the PCD cutting element of about 20 degrees, an in-feed for the PCD cutting element of about 6.35 mm/rev, a rotary speed of the workpiece to be cut of about 101 rpm, and the workpiece may be made from Barre granite having a 914 mm outer diameter and a 254 mm inner diameter. During the $G_{ratio}$ test, the workpiece is cooled with a coolant, such as water.

PCD formed by sintering diamond particles having the same diamond particle size distribution as a PCD embodiment of the invention, but sintered at a cell pressure of, for example, up to about 5.5 GPa and at temperatures in which diamond is stable may exhibit a coercivity of about 100 Oe or less and/or a specific magnetic saturation of about 16 $G\cdot cm^3/g$ or more. Thus, in one or more embodiments of the invention, PCD exhibits a metal-solvent catalyst content of less than 7.5 weight % and a greater amount of diamond-to-diamond bonding between diamond grains than that of a PCD sintered at a lower pressure, but with the same precursor diamond particle size distribution and catalyst.

It is currently believed by the inventor that forming the PCD table 106 by sintering diamond particles at a cell pressure of at least about 7.5 GPa may promote nucleation and growth of diamond between the diamond particles being sintered so that the volume of the interstitial regions of the PCD table 106 so-formed is decreased compared to the volume of interstitial regions if the same diamond particle distribution was sintered at a pressure of, for example, up to about 5.5 GPa and at temperatures where diamond is stable. For example, the diamond may nucleate and grow from carbon provided by dissolved carbon in metal-solvent catalyst (e.g., liquefied cobalt) infiltrating into the diamond particles being sintered, partially graphitized diamond particles, carbon from a substrate, carbon from another source (e.g., graphite particles and/or fullerenes mixed with the diamond particles), or combinations of the foregoing. This nucleation and growth of diamond in combination with the sintering pressure of at least about 7.5 GPa may contribute to PCD table 106 so-formed having a metallic constituent content of less than about 7.5 weight %. More details about the magnetic characteristics of the PCD table 106, techniques for fabricating the PCD table 106, and techniques for measuring the magnetic characteristics may found in U.S. Pat. No. 7,866,418.

Figure 2:
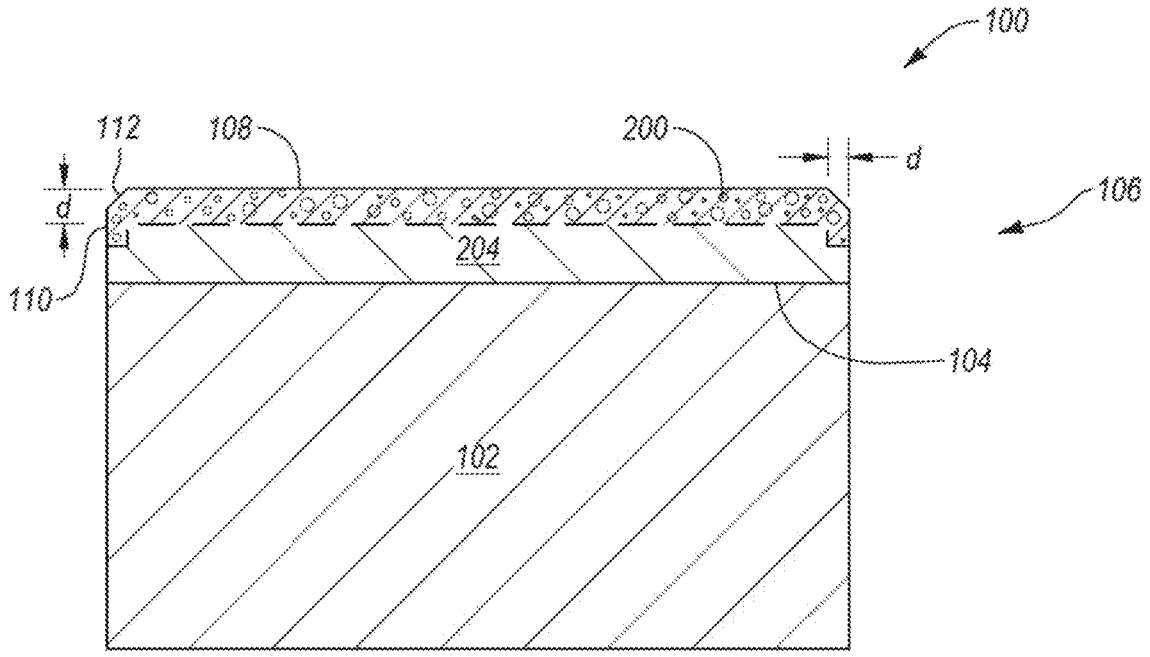
FIG. 2 is a cross-sectional view of the PDC shown in FIG. 1B after leaching a region of the PCD table that is remote from the cemented carbide substrate according to an embodiment.

FIG. 2 is a cross-sectional view of an embodiment of the PDC 100 after a selected portion of the PCD table 106 has been leached to at least partially remove the metallic constituent therefrom. After leaching in a suitable acid (e.g., nitric acid, hydrochloric acid, hydrofluoric acid, or mixtures thereof) for a suitable period of time (e.g., 12-24 hours), the PCD table 106 includes a leached region 200 that extends inwardly from the upper surface 108 to a selected depth d. The leached region 200 may also extend inwardly from the at least one lateral surface 110 and/or the optional chamfer 112 to a selected distance d. The leached region 200 may extend along any desired edge geometry (e.g., the chamfer 112, a radius, etc.) and/or the lateral surface 110, as desired. The PCD table 106 further includes a region 204 that is relatively unaffected by the leaching process. The depth d may be about 10 μm to about 1000 μm, such as about 10 μm to about 500 μm, about 20 μm to about 150 μm, about 30 μm to about 90 μm, about 20 μm to about 75 μm, about 200 μm to about 300 μm, or about 250 μm to about 500 μm. The leached region 200 may still include a residual amount of the metallic constituent. For example, the residual amount of the metallic constituent may be about 0.5 weight % to about 1.50 weight % and, more particularly, about 0.7 weight % to about 1.2 weight % of the PCD table 106.

Figure 3:
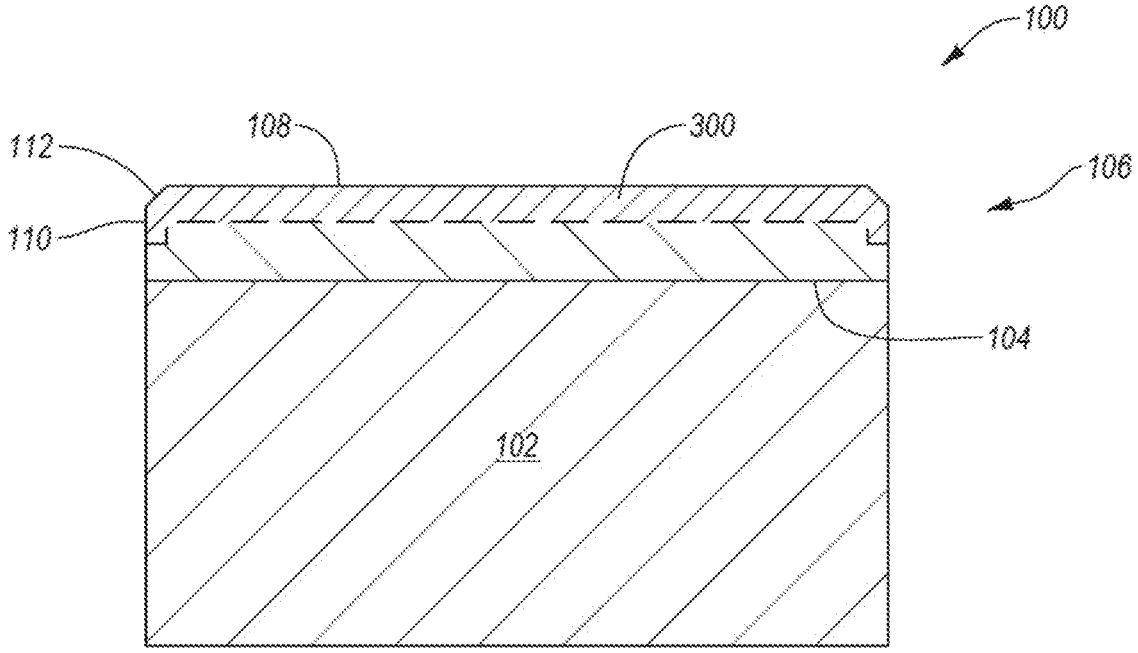
FIG. 3 is a cross-sectional view of the PDC shown in FIG. 2 after infiltrating the leached region of the PCD table with an infiltrant/replacement material according to an embodiment.

FIG. 3 is a cross-sectional view of the PDC 100 shown in FIG. 1B after optionally infiltrating the leached region 200 of the PCD table 106 that is remote from the cemented carbide substrate 102 to form an infiltrated region 300. The infiltrant may be selected from silicon, silicon-cobalt alloys, a nonmetallic catalyst, and combinations of the foregoing. For example, the nonmetallic catalyst may be selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur and/or a derivative thereof, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a germanium alloy), and combinations of the foregoing.

One suitable carbonate catalyst is an alkali metal carbonate material including a mixture of sodium carbonate, lithium carbonate, and potassium carbonate that form a low-melting ternary eutectic system. This mixture and other suitable alkali metal carbonate materials are disclosed in U.S. patent application Ser. No. 12/185,457, which is incorporated herein, in its entirety, by this reference. The alkali metal carbonate material disposed in the interstitial regions of the infiltrated region 300 may be partially or substantially completely converted to one or more corresponding alkali metal oxides by suitable heat treatment following infiltration.

In any of the embodiments disclosed herein, the cementing constituent of the cemented carbide substrate 102 may exhibit a substantially continuous concentration gradient such that a first portion of the cemented carbide substrate 102 (e.g., at or near a center of the substrate) has a different cementing constituent concentration than a second portion (e.g., at or near an outer lateral surface) of the cemented carbide substrate 102. The concentration gradient may be substantially continuous so that no abrupt change in concentration occurs, but that the concentration gradient smoothly increases or decreases with increasing distance from the first portion to the second portion. Providing relatively lower cementing constituent concentration in one portion (e.g., at or near the outer surface of the substrate) provides increased hardness and wear resistance to this portion relative to another portion with higher cementing constituent concentration. The higher cementing constituent concentration provides increased toughness to this corresponding portion. For example, it may be desirable to provide increased toughness at or near the center of the substrate, while providing increased wear resistance at or near the outer lateral surface of the substrate. Characteristics that can be so tailored through manipulation of the concentration gradient of the cementing constituent include, but are not limited to, toughness, wear resistance, abrasion resistance, erosion resistance, corrosion resistance, and thermal stability. Additional details regarding different suitable embodiments for the cemented carbide substrate 102 having a cementing constituent concentration gradient and techniques for fabricating such cementing constituent concentration gradients in a cemented carbide substrate are disclosed in U.S. Provisional Patent Application No. 61/727,841 filed on 19 Nov. 2012, the disclosure of which is incorporated herein, in its entirety, by this reference.

Figure 4A:
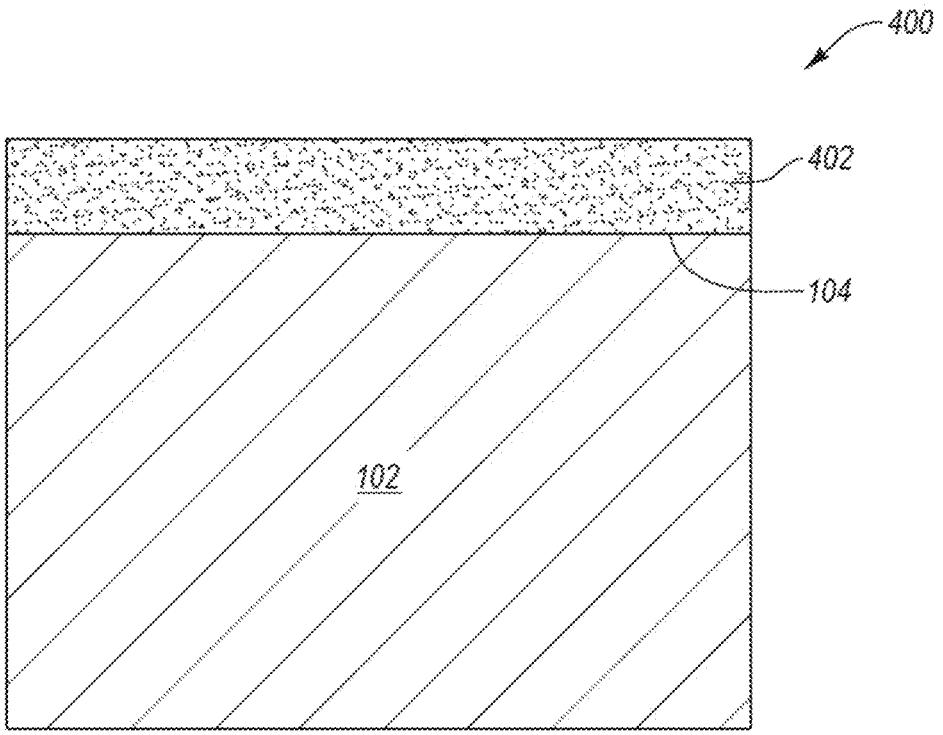
FIG. 4A is a cross-sectional view of an assembly to be HPHT processed to form the PDC shown in FIGS. 1A and 1B according to an embodiment of method.

FIG. 4A is a cross-sectional view of an assembly 400 to be HPHT processed to form the PDC shown in FIGS. 1A and 1B according to an embodiment of method. The assembly 400 includes at least one layer 402 of un-sintered diamond particles (i.e., diamond powder) positioned adjacent to the interfacial surface 104 of the cemented carbide substrate 102. The plurality of diamond particles of the at least one layer 402 may exhibit one or more selected sizes, such as any of the sizes disclosed herein for the diamond grain sizes. For example, the one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. The plurality of diamond particles may also include three or more different sizes (e.g., one relatively larger size and two or more relatively smaller sizes) without limitation.

The assembly 400 of the cemented carbide substrate 102 and the at least one layer 402 of diamond particles may be placed in a pressure transmitting medium, such as a refractory metal can embedded in pyrophyllite or other pressure transmitting medium. The pressure transmitting medium, including the assembly 600, may be subjected to an HPHT process using an ultra-high pressure press to create temperature and cell pressure conditions at which diamond is stable. The temperature of the HPHT process may be at least about 1000° C. (e.g., about 1200° C. to about 1600° C.) and the cell pressure of the HPHT process may be at least 4.0 GPa (e.g., at least about 7.5 GPa, about 5.0 GPa to about 10.0 GPa, about 7 GPa to about 8.5 GPa) for a time sufficient to sinter the diamond particles to form the PCD table 106 (FIGS. 1A and 1B). For example, the cell pressure of the HPHT process may be about 5 GPa to about 9 GPa and the temperature of the HPHT process may be about 1150° C. to about 1450° C. (e.g., about 1200° C. to about 1400° C.). Upon cooling from the HPHT process, the PCD table 106 becomes metallurgically bonded to the cemented carbide substrate 102. Additional details about suitable HPHT process conditions are disclosed in U.S. Pat. No. 7,866,418. In some embodiments, the PCD table 106 may be leached to enhance the thermal stability thereof (e.g., as previously described with respect to FIG. 2) and, optionally the leached region may be infiltrated with any of the disclosed infiltrants.

During the HPHT process, a portion of the cobalt-containing cementing constituent from the cemented carbide substrate 102 may liquefy and infiltrate into the diamond particles of the at least one layer 402. The infiltrated cobalt-containing cementing constituent functions as a catalyst that catalyzes formation of directly bonded-together diamond grains to sinter the diamond particles so that the PCD table 106 is formed.

The interfacial surface 104 of the cemented carbide substrate 102 is substantially free of abnormal grain growth of tungsten carbide grains, which can project into the PCD table 106 and promote de-bonding thereof from the cemented carbide substrate 102. For example, the tungsten carbide grains exhibiting abnormal grain growth may comprise about 5% or less of the total surface area of the interfacial surface, such as greater than 0 to about 5%, about 1% to about 4%, about 2% to about 4%, about 3% or less, or about 1% to about 2%. The extent of any abnormal grain growth of tungsten carbide grains at the interfacial surface 104 may be determined via a number of suitable analytical techniques, such as quantitative optical or electron microscopy, ultrasonic imaging, x-ray radiography, or other suitable technique. The inventor currently believes that this is due to the relatively fine tungsten carbide grain size of the cemented carbide substrate 102, which limits the amount of cobalt-containing cementing constituent exposed to diamond particles during the HPHT sintering process that serve as a carbon source for abnormal growth of the tungsten carbide grains. However, abnormal grain growth at the interfacial surface 104 may also be substantially eliminated when the PCD table is preformed and bonded to the interfacial surface 104 of the cemented carbide substrate 106. In a cobalt-cemented tungsten carbide substrate having an average tungsten carbide grain size of about 3 μm, the inventor found the presence of abnormal grain growth of tungsten carbide grains (also known as carbide plumes) at the interfacial surface 104 using ultrasonic testing, while cobalt-cemented tungsten carbide substrates having an average tungsten carbide grain size of about 1.3 μm according to an embodiment of the invention was substantially free of abnormal grain growth of tungsten carbide grains at the interfacial surface 104 as also confirmed by ultrasonic testing. Tungsten carbide grains that exhibit abnormal grain growth generally exhibit an elongated geometry having an average grain size and aspect ratio that is about 2 times or more (e.g., about 3 to about 8 times, or about 3 to about 5 times) than generally equiaxed tungsten carbide grains of the cemented carbide substrate 102. For example, tungsten carbide grains that exhibit abnormal grain growth may have an average length of about 8 μm to about 15 μm, such as, about 8 μm to about 10 μm.

As a result of the cobalt-containing cementing constituent sweeping into the at least one layer 402, the cemented carbide substrate 102 exhibits a deeper depletion zone of the cobalt-containing cementing constituent extending inwardly from the interfacial surface 104 of the cemented carbide substrate 102 than would be present if a conventional cobalt-cemented tungsten carbide substrate were used (e.g., Standard Grade—about 13 weight % cobalt, balance tungsten carbide grains of about 3 μm in average size). For example, in some embodiments, the cemented carbide substrate 102 may include a depletion zone that exhibits a depth extending inwardly from the interfacial surface 104 of about 30 μm to about 60 μm, about 30 μm to about 50 μm, about 30 μm to about 35 μm, or about 32 μm to about 45 μm. In some cases, the overall volume of the cobalt-containing cementing constituent depleted from the depletion zone may be the same or similar than if a conventional cobalt-cemented tungsten carbide substrate were employed, but the depletion zone may extend to a relatively deeper depth. The depletion zone adjacent to the interface may exhibit a Palmquist fracture toughness of about 6 $MPa \cdot m^{0.5}$ to about 9 $MPa \cdot m^{0.5}$ (e.g., about 7 $MPa \cdot m^{0.5}$ to about 8 $MPa \cdot m^{0.5}$, or about 6.5 $MPa \cdot m^{0.5}$ to about 8.5 $MPa \cdot m^{0.5}$), and the cemented carbide substrate 102 remote from the depletion zone may exhibit a bulk Palmquist fracture toughness is about 6 $MPa \cdot m^{0.5}$ to about 12 $MPa \cdot m^{0.5}$ (e.g., about 7 $MPa \cdot m^{0.5}$ to about 8 $MPa \cdot m^{0.5}$, or about 8 $MPa \cdot m^{0.5}$ to about 12 $MPa \cdot m^{0.5}$). Palmquist fracture toughness is determined by a method that uses the corner crack length of a Vickers hardness indentation in a material to derive the fracture toughness.

Figure 4B:
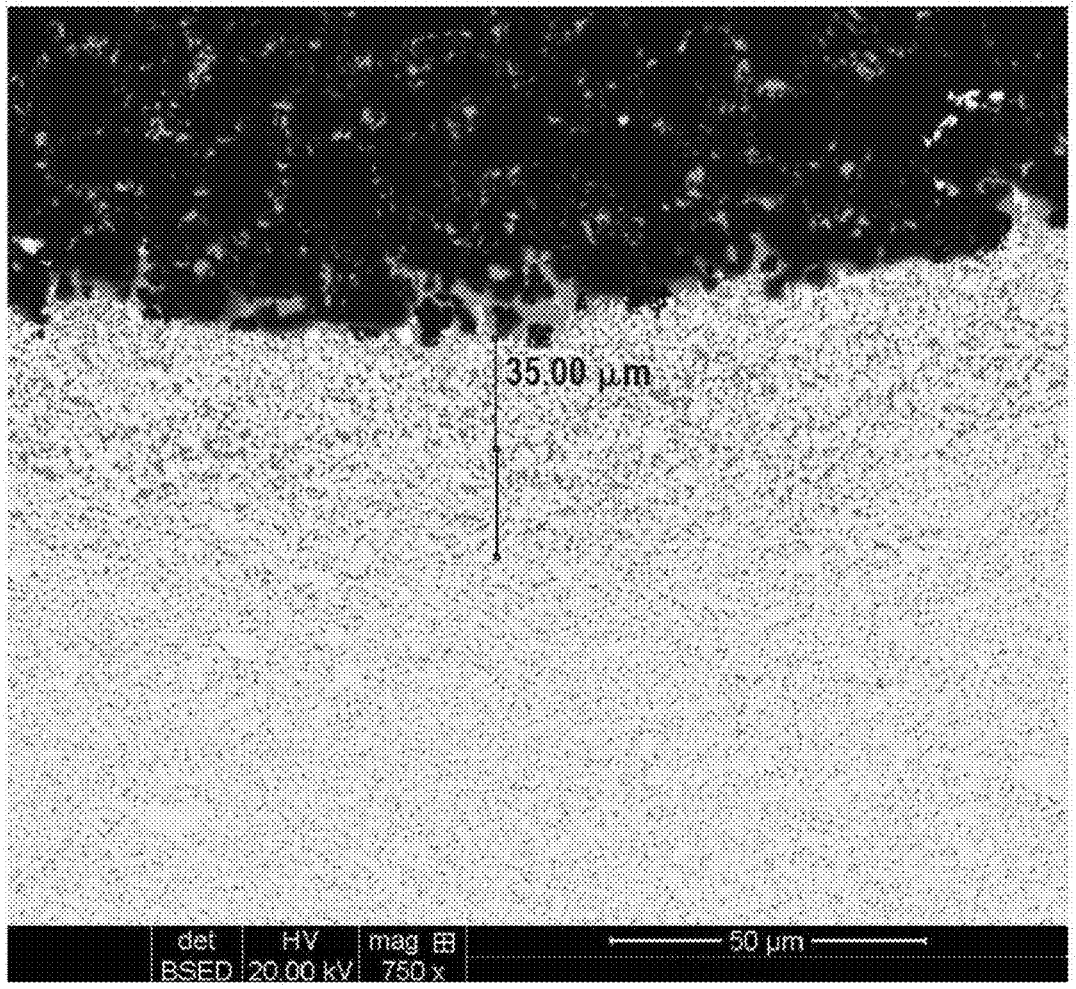
FIG. 4B is a scanning electron photomicrograph of the depletion zone in a cobalt-cemented tungsten carbide substrate of a PDC formed by HPHT sintering diamond particles on the cobalt-cemented tungsten carbide substrate having an average tungsten carbide grain size of about 1.3 μm or less and about 13 weight % cobalt and about 87 weight % tungsten carbide.
Figure 4B:
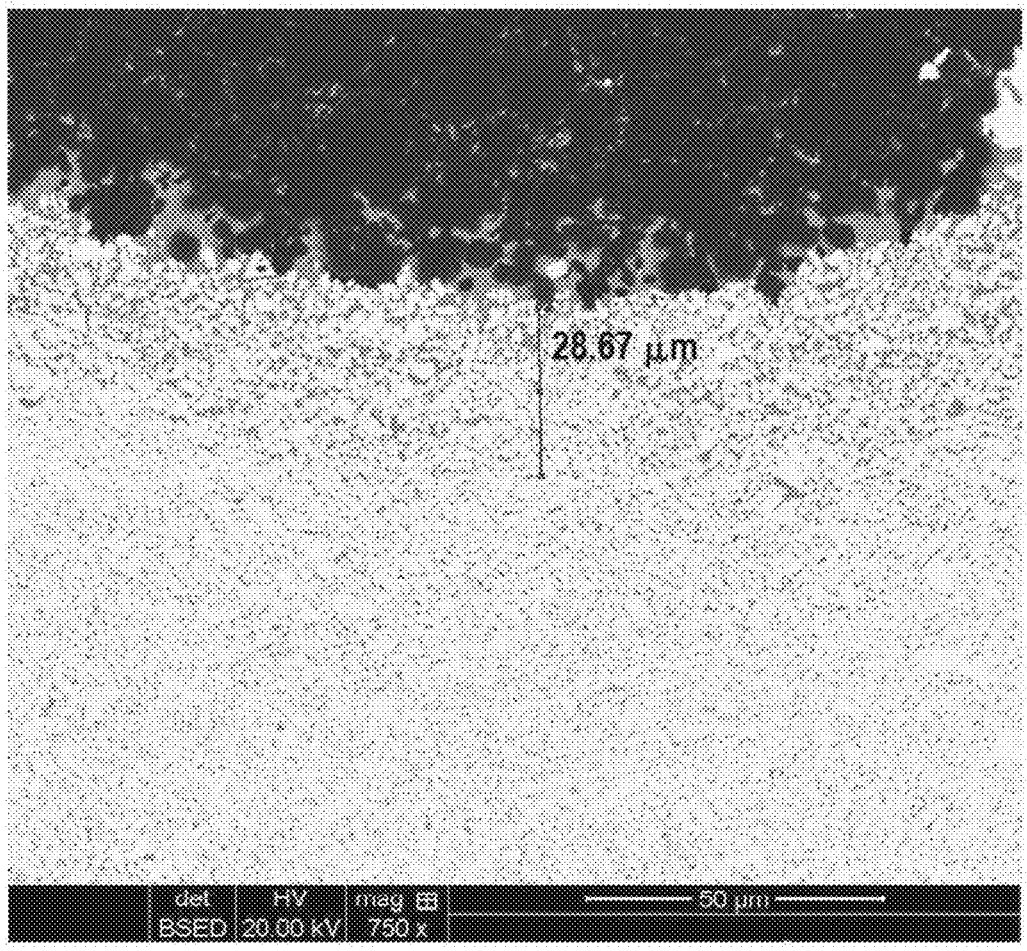

For example, FIG. 4B is a scanning electron photomicrograph of the depletion zone in a cobalt-cemented tungsten carbide substrate of a PDC formed by HPHT sintering diamond particles having an average particle size of about 19 μm on the cobalt-cemented tungsten carbide substrate having an average tungsten carbide grain size of about 1.3 μm or less and about 13 weight % cobalt and about 87 weight % tungsten carbide. As shown in FIG. 4B, the depletion zone in the cobalt-cemented tungsten carbide substrate was measured to be about 35 μm. As shown in FIG. 4BB, the depletion zone in a cobalt-cemented tungsten carbide substrate having an average tungsten carbide grain size of about 3 μm and about 13 weight % cobalt and about 87 weight % tungsten carbide was measured to be about 29 μm.

Figure 4C:
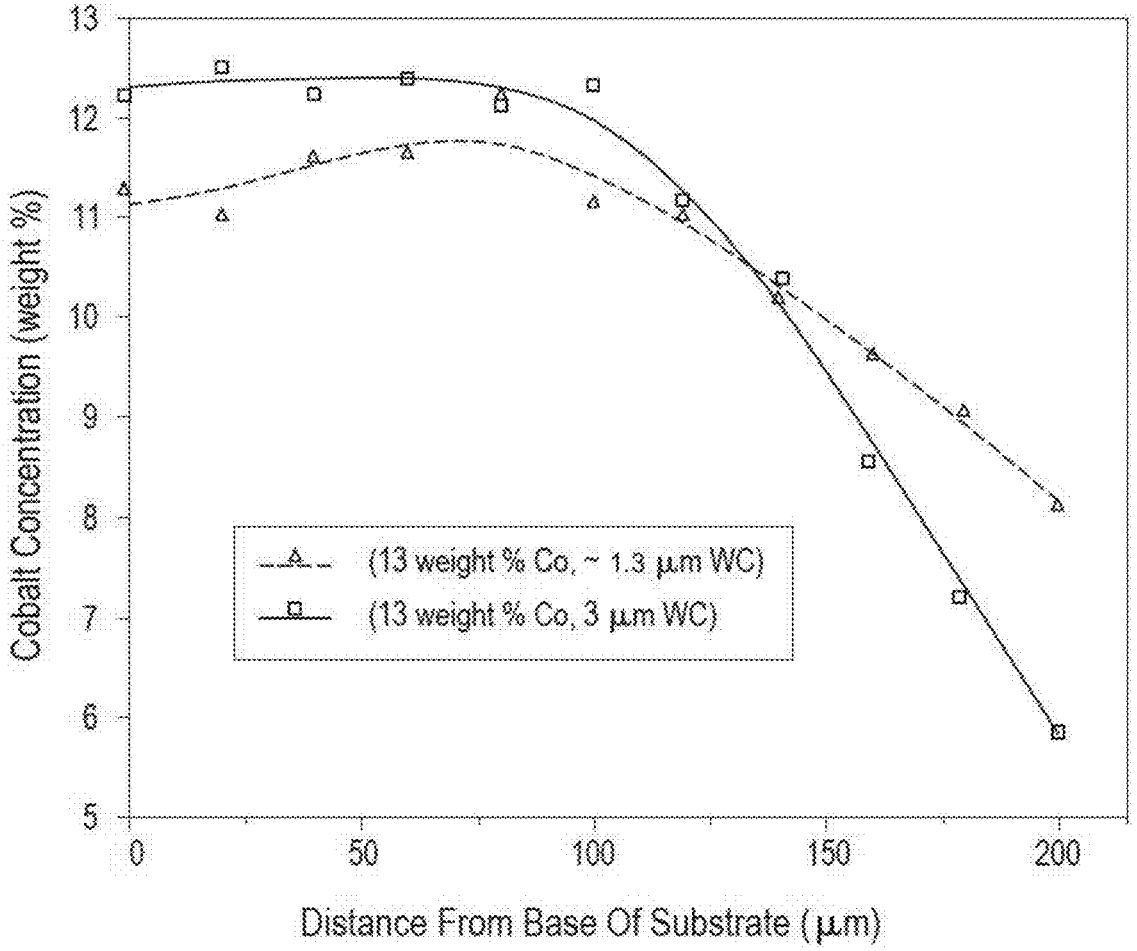
FIG. 4C is a graph of cobalt concentration with increasing distance from the base of the cobalt-cemented tungsten carbide substrate for one PDC sample according to an embodiment of the invention having an average tungsten carbide grain size of about 1.3 μm or less and about 13 weight % cobalt and about 87 weight % tungsten carbide, and another PDC sample having an average tungsten carbide grain size of about 3 μm or less and about 13 weight % cobalt and about 87 weight % tungsten carbide.

FIG. 4C is a graph of cobalt concentration with increasing distance from the base of the cobalt-cemented tungsten carbide substrate for one PDC sample according to an embodiment of the invention having an average tungsten carbide grain size of about 1.3 μm or less and about 13 weight % cobalt and about 87 weight % tungsten carbide, and another PDC sample having an average tungsten carbide grain size of about 3 μm or less and about 13 weight % cobalt and about 87 weight % tungsten carbide. As shown in FIG. 4C, use of the relatively fine tungsten carbide grains having an average grain size of about 1.3 μm or less according to an embodiment of the invention provided for a more gradual decrease in cobalt concentration in the depletion zone compared to the sample that used an average tungsten carbide grain size of about 3 μm. For example, with the relatively fine 1.3 μm tungsten carbide grain size, the cobalt concentration may decrease from between a range of about 11 weight %-about 13 weight % to a range of about 7 weight %-about 8 weight % proximate to the interfacial surface with the PCD table. Stated another way, the cobalt concentration may decrease by about 20% to about 40% (e.g., about 20% to about 30%, or about 22% to about 25%) proximate to the interfacial surface from the cobalt concentration proximate to the base of the cobalt-cemented tungsten carbide substrate (i.e., bulk concentration of the cobalt).

The deeper depletion zone is believed to provide a more gradual transition layer, which may help prevent braze cracking (also known as liquid metal embrittlement) when the cemented carbide substrate 102 is brazed to another structure, such as a bit body of a rotary drill bit. As evidence of this, 14 PDC samples according to an embodiment of the invention having an average tungsten carbide grain size of about 1.3 μm or less and about 13 weight % cobalt and about 87 weight % tungsten carbide, and 14 PDC samples having an average tungsten carbide grain size of about 3 μm or less and about 13 weight % cobalt and about 87 weight % tungsten carbide were tested for susceptibility to braze cracking. Each PDC sample was heated at 1060° C. for 20 seconds, while the PCD table of the PDC was maintained at room temperature due to being enclosed by a cooling jacket. After cooling the PDC sample to room temperature, ultrasonic testing was performed to nondestructively probe for cracks in the cobalt-cemented carbide substrate. The heating cycle and ultrasonic testing was repeated five times. After five cycles, the PDC samples according to an embodiment of the invention had zero cracks, while nine of the other PDC samples were cracked in the cobalt-cemented carbide substrate.

The impact resistance of the PDC according to an embodiment having an average tungsten carbide grain size of about 1.3 μm or less and about 13 weight % cobalt and about 87 weight % tungsten carbide was also unexpectedly and surprisingly enhanced relative to a PDC having cobalt-cemented tungsten carbide substrate with an average tungsten carbide grain size of about 3 μm or less and about 13 weight % cobalt/about 87 weight % tungsten carbide. One of ordinary skill in the art would expect that the finer grain size of the tungsten carbide grains in the cemented carbide substrate 102 would decrease the impact resistance thereof relative to a cemented carbide substrate having a relatively larger grain size.

Figure 4D:
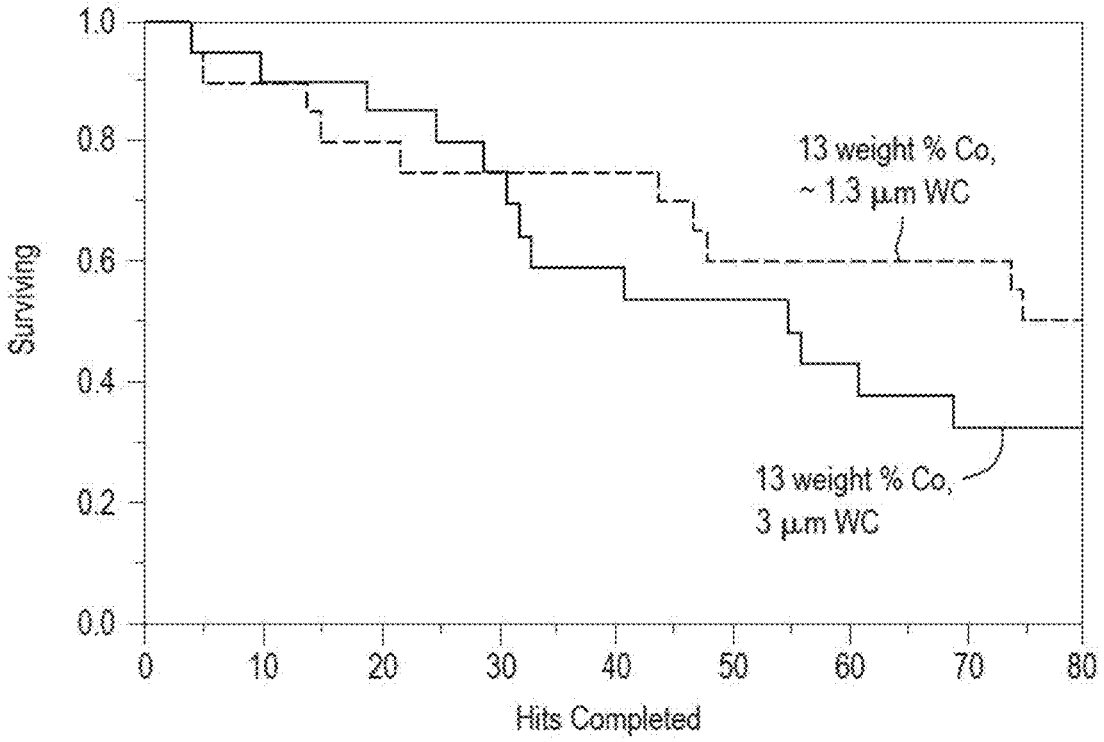
FIG. 4D is a probability to failure for tested PDCs versus number of hits completed to failure for the impact tests on PDCs fabricated according to an embodiment of the invention having an average tungsten carbide grain size of about 1.3 μm or less and about 13 weight % cobalt and about 87 weight % tungsten carbide, and standard PDC samples having an average tungsten carbide grain size of about 3 μm or less and about 13 weight % cobalt and about 87 weight % tungsten carbide.

The PDCs according to an embodiment of the invention and the standard PDCs were subjected to impact testing to evaluate their impact resistance. In the impact test on each PDC, a weight was vertically dropped on a sharp, non-chamfered edge of a PCD table of a PDC to impact the edge with 40 J of energy. The tested PDC was oriented at about a 15 degree back rake angle so that the edge of the PCD table is directly impacted by the weight. The test was repeated until the tested PDC failed. The PDC was considered to have failed when about 30% of the PCD table has spalled and/or fractured. As shown in the survival plot of FIG. 4D, the PDCs according to an embodiment of the invention having the about 1.3 μm average grain size tungsten carbide grains had a significantly higher survival probability than PDCs having a cemented carbide substrate with an average tungsten grain size of about 3 μm. For a given number of hits by the impact test weight, the PDCs according to an embodiment of the invention had a significantly lower probability of failure than the standard PDCs. The inventor currently believes that this significantly lower probability of failure is due to the lower amount of cobalt depleted from the depletion zone adjacent to the interface compared to the standard PDC. Such a configuration may exhibit a higher Palmquist fracture toughness in the depletion zone adjacent to the PCD table. Put another way, the depletion zone according to embodiments of the invention retains a higher weight % of cobalt adjacent to the interface than conventional PDCs. When failure occurred, failure after impact extended through the PCD table to the depletion zone.

In addition to the other improved properties, the cemented tungsten carbide substrates having about 1.3 μm average grain size tungsten carbide grains and about 13 weight % cobalt and about 87 weight % tungsten carbide had improved corrosion resistance compared to a cemented tungsten carbide substrate with an average tungsten carbide grain size of about 3 μm or less and about 13 weight % cobalt/about 87 weight % tungsten carbide. Immersing a polished surface of both types of cemented tungsten carbide substrates in 10% hydrochloric acid for about 24 hours generated significantly wider corrosion pits in the cemented tungsten carbide substrate with the 3 μm tungsten carbide grain size. The corrosion pits in the cemented tungsten carbide substrate with the 3 μm tungsten carbide grain size were 5 times wider than those in the cemented tungsten carbide substrate having average tungsten grain size of 1.3 μm. For example, corrosion pits in the cemented tungsten carbide substrate with the 1.3 μm tungsten carbide grain size may be about ⅕ times or less wide, about ¼ to about ⅕ times wide, about ⅓ to about ⅕ times wide, about ½ to about ¼ times wide, or about ⅓ to about ¼ wide than that of the corrosion pits in the cemented tungsten carbide substrate having average tungsten grain size of 3 μm. For example, the corrosion pits in the cemented tungsten carbide substrate with the 3 μm tungsten carbide grain size may have an average width of about 3 μm to about 6 μm and the corrosion pits in the cemented tungsten carbide substrate having average tungsten grain size of 1.3 μm may have an average width of about 0.5 μm to about 2.5 μm, such as about 1.5 μm to about 2 μm, or about 1.8 μm to about 1.85 μm, or about 1 μm to about 1.5 μm after immersing in 10% hydrochloric acid for 24 hours.

Figure 4E:
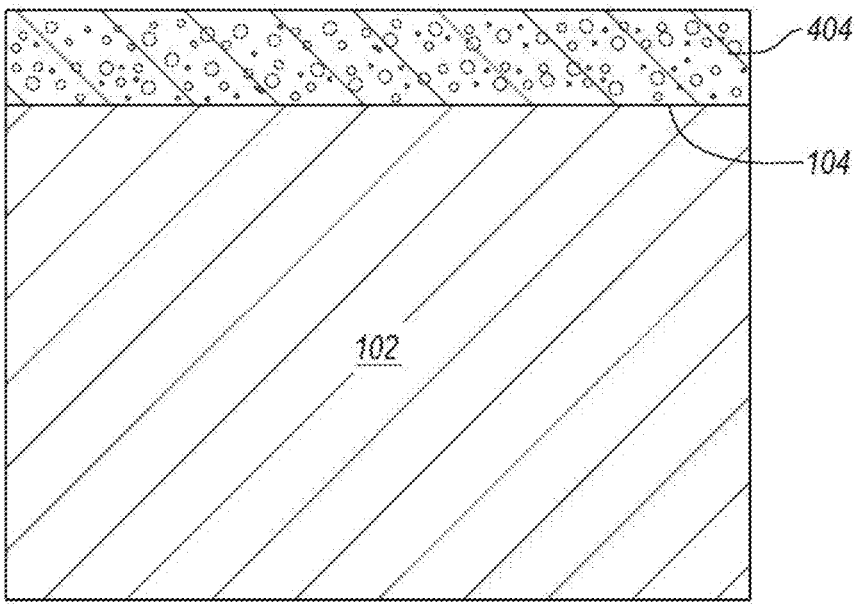
FIG. 4E is a cross-sectional view of an assembly to be HPHT processed to form the PDC shown in FIGS. 1A and 1B according to another embodiment of method.

In another embodiment, the at least one layer 402 of diamond particles shown in FIG. 4A may be replaced with another type of diamond volume. For example, the at least one layer 402 of diamond particles may be replaced with a porous, at least partially leached PCD table that is infiltrated with a cobalt-containing cementing constituent from a cemented carbide substrate 102 and attached thereto during an HPHT process using any of the diamond-stable HPHT process conditions disclosed herein. For example, the cobalt-containing cementing constituent from the cemented carbide substrate 102 shown in FIG. 4A may partially or substantially completely infiltrate into the at least partially leached PCD table. Upon cooling from the HPHT process, a strong metallurgical bond is formed between the infiltrated PCD table and the substrate. FIG. 4E shows an at least partially leached PCD table 404 positioned adjacent to a cemented carbide substrate 102 to form an assembly that is HPHT processed to form the PDC 100. During HPHT processing, a portion of the cobalt-containing cementing constituent from the cemented carbide substrate 102 or a metallic infiltrant from another source may infiltrate into the pores of the at least partially leached PCD table 404. Upon cooling from the HPHT process, the infiltrant forms a strong metallurgical bond between the infiltrated PCD table and the cemented carbide substrate 102.

The at least partially leached PCD table 404 includes a plurality of directly bonded-together diamond grains exhibiting diamond-to-diamond bonding therebetween (e.g., $sp^3$ bonding). The plurality of directly bonded-together diamond grains define a plurality of interstitial regions. The interstitial regions form a network of at least partially interconnected pores that enable fluid to flow from one side to an opposing side.

The at least partially leached PCD table 404 may be formed by HPHT sintering a plurality of diamond particles having any of the aforementioned diamond particle size distributions in the presence of a metal-solvent catalyst (e.g., iron, nickel, cobalt, or alloys thereof) under any of the disclosed diamond-stable HPHT conditions. For example, the metal-solvent catalyst may be infiltrated into the diamond particles from a metal-solvent-catalyst disc (e.g., a cobalt disc), infiltrated from a cobalt-cemented tungsten carbide substrate, mixed with the diamond particles, or combinations of the foregoing. At least a portion of or substantially all of the metal-solvent catalyst may be removed from the sintered PCD body by leaching. For example, the metal-solvent catalyst may be at least partially removed from the sintered PCD table by immersion in an acid, such as aqua regia, nitric acid, hydrofluoric acid, or other suitable acid, to form the at least partially leached PCD table. The sintered PCD table may be immersed in the acid for about 2 to about 7 days (e.g., about 3, 5, or 7 days) or for a few weeks (e.g., about 4 weeks) depending on the amount of leaching that is desired. It is noted that a residual amount of the metal-solvent catalyst may still remain even after leaching for extended periods of time.

When the metal-solvent catalyst is infiltrated into the diamond particles from a cemented tungsten carbide substrate including tungsten carbide grains cemented with a metal-solvent catalyst (e.g., cobalt, nickel, iron, or alloys thereof), the infiltrated metal-solvent catalyst may carry tungsten and/or tungsten carbide therewith. The at least partially leached PCD table may include such tungsten and/or tungsten carbide therein disposed interstitially between the bonded diamond grains. The tungsten and/or tungsten carbide may be at least partially removed by the selected leaching process or may be relatively unaffected by the selected leaching process.

If desired, after infiltrating and bonding the at least partially leached PCD table to the cemented carbide substrate 102, the cobalt-containing cementing constituent that occupies the interstitial regions may be at least partially removed in a subsequent leaching process using an acid (e.g., aqua regia, nitric acid, hydrofluoric acid, or other suitable acid) to form, for example, the leached region 200 shown in FIG. 2. If desired, the leached region 200 may be infiltrated with any of the infiltrant materials disclosed herein.

Figure 4F:
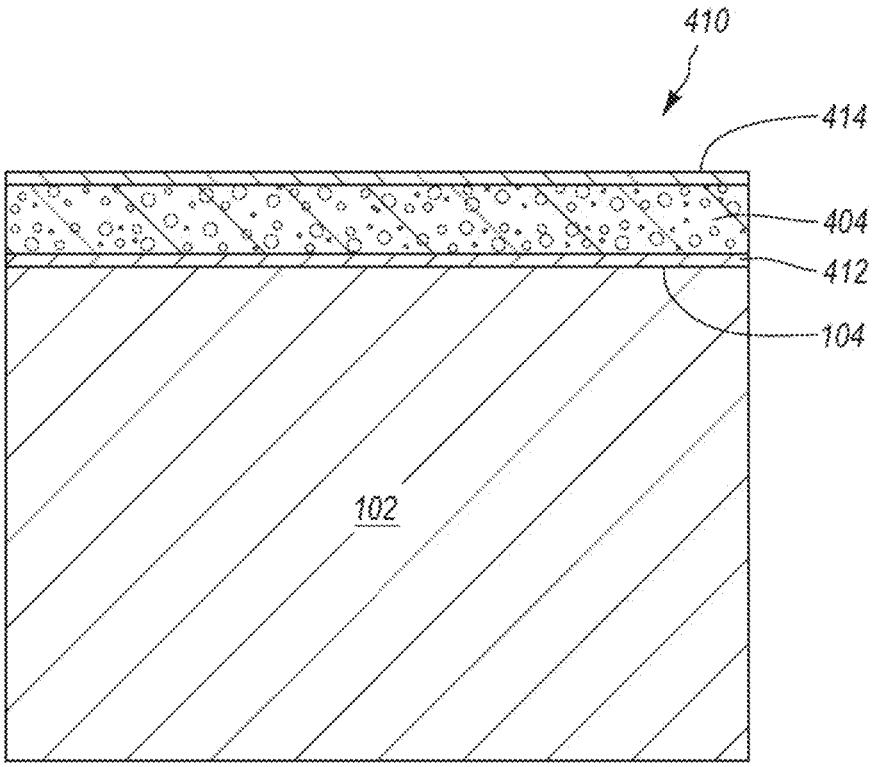
FIG. 4F is a cross-sectional view of an assembly to be HPHT processed in which an at least partially leached PCD table is infiltrated from both sides thereof with different infiltrants according to an embodiment of a method.

Referring to FIG. 4F, in other embodiments, one or more other metallic infiltrants may be disposed between the at least partially leached PCD table 404 and the cemented carbide substrate 102 and/or at least partially enclose the at least partially leached PCD table 404. Such infiltrants may partially or substantially completely infiltrates into the at least partially leached PCD table 404.

FIG. 4F is a cross-sectional view of an assembly 410 to be HPHT processed in which an at least partially leached PCD table 404 is infiltrated from both sides thereof with different infiltrants according to an embodiment of a method. Such an embodiment may better facilitate infiltration of the porous, at least partially leached PCD 404 when the at least partially leached PCD table 404 is formed at a cell pressure greater than about 7.5 GPa and has relatively small interstitial region pore volume. The assembly 410 includes a first infiltrant 412 disposed between the at least partially leached PCD table 404 and the cemented carbide substrate 102. The first infiltrant 412 may be in the form of a foil, powder, paste, or disc. A second infiltrant 414 may be disposed adjacent to the upper surface 406 of the at least partially leached PCD table 404 such that the at least partially leached PCD table 404 is disposed between the first infiltrant 412 and the second infiltrant 414.

The first and second infiltrants 412 and 414 may be formed from a variety of different metals and alloys. For example, the first infiltrant 412 may be formed from a nickel-silicon alloy, a nickel-silicon-boron alloy, a cobalt-silicon alloy, cobalt-silicon-boron alloy, or combinations thereof. Examples of nickel-silicon alloys, nickel-silicon-boron alloys, cobalt-silicon alloys, and cobalt-silicon-boron alloys that may be used for the first infiltrant 412 are disclosed in U.S. patent application Ser. No. 13/795,027 filed on 12 Mar. 2013, the disclosure of which is incorporated herein, in its entirety, by this reference.

The second infiltrant 414 may have a melting temperature or liquidus temperature at standard pressure of less than about 1300° C. The second infiltrant may also be more readily removed (e.g., leached) from the PCD table than a pure cobalt or pure nickel infiltrant, or cobalt provided from a cobalt-cemented tungsten carbide substrate. Examples of metals and alloys for the second infiltrant 414 that facilitate faster, more complete leaching include, but are not limited to copper, tin, germanium, gadolinium, magnesium, lithium, silver, zinc, gallium, antimony, bismuth, cupro-nickel, mixtures thereof, alloys thereof, and combinations thereof. Examples of metal and alloys that may be used for the second infiltrant 414 are disclosed in U.S. patent application Ser. No. 13/795,027.

The assembly 410 may be subjected to any of the HPHT process conditions disclosed herein during which the first infiltrant 414 liquefies and infiltrates into the at least partially leached PCD table 404 along with the second infiltrant 416. Depending on the volume of the porosity in the at least partially leached PCD table 404 and the volumes of the first and second infiltrants 412 and 414, a metallic infiltrant from the cemented carbide substrate 102 (e.g., cobalt from a cobalt-cemented tungsten carbide substrate) may also infiltrate into the at least partially leached PCD table 404 following infiltration of the first infiltrant 412. At least some of the interstitial regions of the infiltrated at least partially leached PCD table 404 may be occupied by an alloy that is a combination of the first infiltrant 412, second infiltrant 414, and (if present) the metallic infiltrant from the cemented carbide substrate 102. Such an alloy may have a composition that varies depending throughout a thickness of the infiltrated at least partially leached PCD table 404, and examples of which are disclosed in U.S. patent application Ser. No. 13/795,027. For example, the alloy may include at least one of nickel or cobalt; at least one of carbon, silicon, boron, phosphorus, cerium, tantalum, titanium, niobium, molybdenum, antimony, tin, or carbides thereof; and at least one of magnesium, lithium, tin, silver, copper, nickel, zinc, germanium, gallium, antimony, bismuth, or gadolinium Upon cooling from the HPHT process, the infiltrated at least partially leached PCD table 404 attaches to the interfacial surface 104 of the cemented carbide substrate 102. After attaching the infiltrated at least partially leached PCD table 404 to the cemented carbide substrate 102, the infiltrated at least partially leached PCD table 404 may be shaped (e.g., chamfering) and/or leached as disclosed in any of the embodiments disclosed herein (e.g., as shown and/or described with reference to FIG. 2) or according to any embodiment disclosed in the above-mentioned U.S. patent application Ser. No. 13/795,027. Of course, the at least partially leached PCD table 404 may be pre-chamfered prior to infiltration in some embodiments.

In other embodiments, the first and second infiltrants 412 and 414 may both be positioned between the at least partially leached PCD table 404 and the cemented carbide substrate 102. For example, the second infiltrant 414 may be disposed between the at least partially leached PCD table 404 and the first infiltrant 412. In other embodiments, the cementing constituent of the cemented carbide substrate 102 may comprise the first infiltrant 412.

It should be noted that a cemented carbide substrate of any PDC disclosed herein may exhibit any combination of values/ranges disclosed herein for average grain size of the tungsten carbide grains, amount of the cobalt-containing cementing constituent, transverse rupture strength, hardness, coercivity, magnetic saturation, depletion zone and bulk Palmquist fracture toughness, and depletion zone concentration profile in combination with a PCD table exhibiting any combination of values/ranges disclosed herein for average diamond grain, amount of the metallic constituent in the PCD table, coercivity, magnetic saturation, and $G_{ratio}$.

Figure 5A:
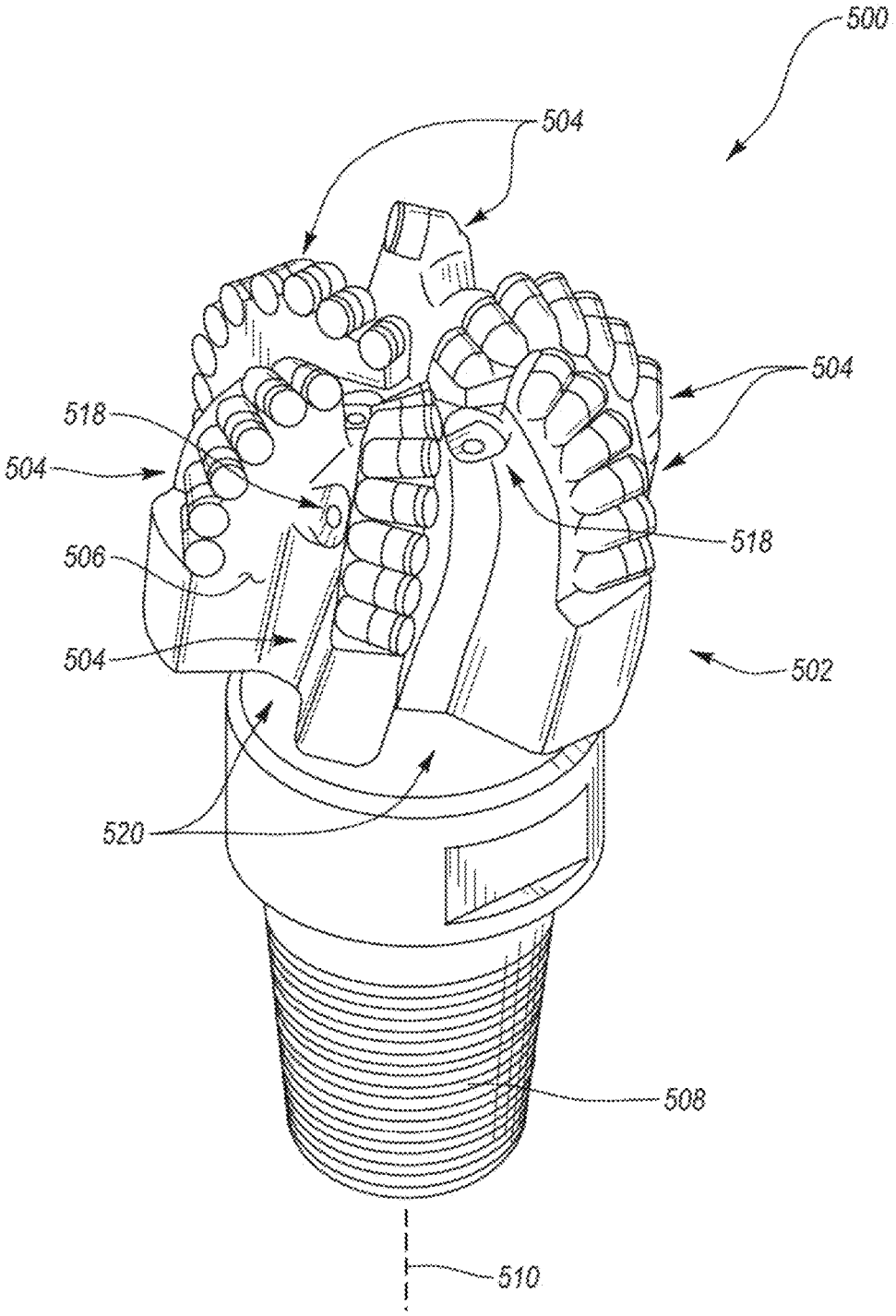
FIG. 5A is an isometric view of an embodiment of a rotary drill bit that may employ one or more of the disclosed PDC embodiments.
Figure 5B:
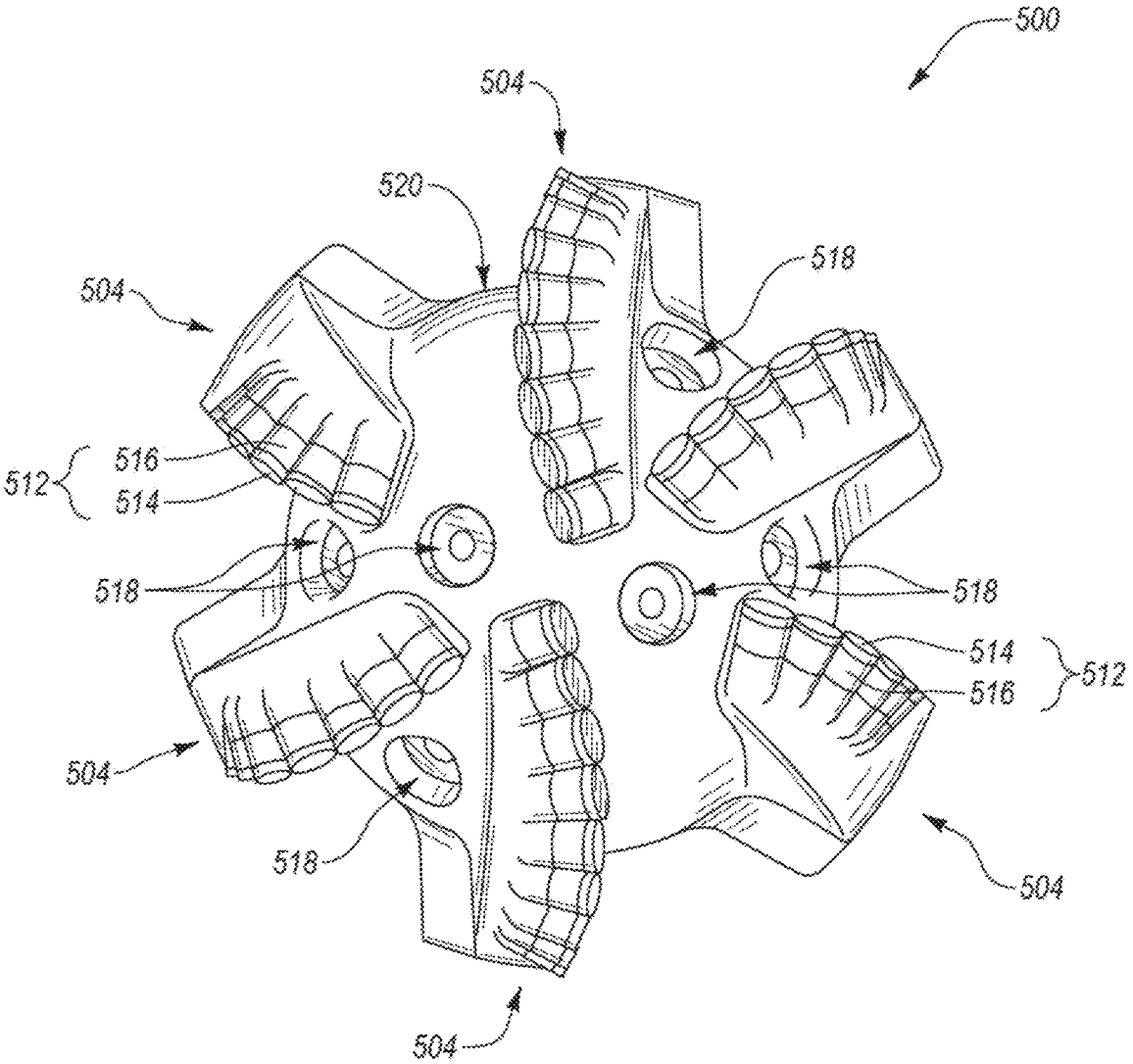
FIG. 5B is a top elevation view of the rotary drill bit shown in FIG. 5A.

FIG. 5A is an isometric view and FIG. 5B is a top elevation view of an embodiment of a rotary drill bit 500. The rotary drill bit 500 includes at least one PDC configured according to any of the previously described PDC embodiments, such as the PDC 100 of FIGS. 1A and 1B. The rotary drill bit 500 comprises a bit body 502 that includes radially- and longitudinally-extending blades 504 having leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. At least one PDC, configured according to any of the previously described PDC embodiments, may be affixed to the bit body 502. With reference to FIG. 5B, each of a plurality of PDCs 512 is secured to the blades 504 of the bit body 502 (FIG. 5A). For example, each PDC 512 may include a PCD table 514 bonded to a substrate 516. More generally, the PDCs 512 may comprise any PDC disclosed herein, without limitation. In addition, if desired, in some embodiments, a number of the PDCs 512 may be conventional in construction. Also, circumferentially adjacent blades 504 define so-called junk slots 520 therebetween. Additionally, the rotary drill bit 500 includes a plurality of nozzle cavities 518 for communicating drilling fluid from the interior of the rotary drill bit 500 to the PDCs 512.

FIGS. 5A and 5B merely depict one embodiment of a rotary drill bit that employs at least one PDC fabricated and structured in accordance with the disclosed embodiments, without limitation. The rotary drill bit 500 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., the PDC 100 shown in FIGS. 1A and 1B) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used on any apparatus or structure in which at least one conventional PDC is typically used. In one embodiment, a rotor and a stator, assembled to form a thrust-bearing apparatus, may each include one or more PDCs (e.g., the PDC 100 shown in FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; 5,180,022; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A drill bit, comprising:

a bit body configured to facilitate drilling a subterranean formation; and a plurality of cutting elements mounted to the bit body, at least one of the plurality of cutting elements including:

a cemented carbide substrate including a cobalt-containing cementing constituent cementing a plurality of tungsten carbide grains together, the plurality of tungsten carbide grains exhibiting an average grain size of about 2.5 μm or less, the cemented carbide substrate including an interfacial surface and a depletion zone that extends inwardly from an interfacial surface thereof to a depth of about 30 μm to about 60 μm, the depletion zone exhibiting a Palmquist fracture toughness of about 6 $MPa \cdot m^{0.5}$ to about 9 $MPa \cdot m^{0.5}$, wherein the cemented carbide substrate excludes chromium; and a polycrystalline diamond table bonded to the interfacial surface of the cemented carbide substrate, the polycrystalline diamond table including a plurality of diamond grains bonded together and defining a plurality of interstitial regions, the plurality of the diamond grains exhibiting an average grain size of about 40 μm or less, at least a portion of the polycrystalline diamond able including a metallic constituent disposed in at least a portion of the plurality of interstitial regions, the metallic constituent of the at least a portion of the polycrystalline diamond table is present in an amount of about 7.5 weight % or less, the at least a portion of the polycrystalline diamond table exhibiting a coercivity of about 115 Oersteds ("Oe") to about 250 Oe and a specific magnetic saturation of about 15 Gauss·$cm^3$/grams ("G·$cm^3$/g") or less.

2. The drill bit of claim 1 wherein the cemented carbide substrate includes a single cemented carbide substrate.

3. The drill bit of claim 1 wherein the average grain size of the plurality of tungsten carbide grains is about 1.5 μm to less.

4. The drill bit of claim 1 wherein the average grain size of the plurality of tungsten carbide grains is about 0.8 μm to about 1.5 μm.

5. The drill bit of claim 1 wherein the depth of the depletion zone is 30 μm to 50 μm.

6. The drill bit of claim 1 wherein the depth of the depletion zone is 32 μm to 45 μm.

7. The drill bit of claim 1 wherein the cobalt-containing cementing constituent is present in the depletion zone in a concentration that is about 20% to about 40% of a bulk concentration of the cobalt-containing cementing constituent in the cemented carbide substrate outside the depletion zone.

8. The drill bit of claim 1 wherein the cemented carbide substrate further includes at least one additional carbide in addition to the plurality of tungsten carbide grains, the at least one additional carbide including vanadium carbide, nickel carbide, tantalum carbide grains, tantalum carbide-tungsten carbide solid solution grains, or combinations thereof.

9. The drill bit of claim 8 wherein the at least one addition carbide is present in the cemented carbide substrate in an amount of about 0.050 weight % to about 3 weight %.

10. The drill bit of claim 1 wherein the cemented carbide substrate excludes tantalum.

11. The drill bit of claim 1 wherein the cemented carbide substrate excludes vanadium and nickel.

12. The drill bit of claim 1 wherein the cemented carbide substrate exhibits a transverse rupture strength of about 460 ksi to about 550 ksi and a hardness of about 89.5 HRa to about 92 HRa.

13. The drill bit of claim 1 wherein the cemented carbide substrate exhibits a coercivity of about 130 to about 150 Oe and a magnetic saturation of about 10 G·$cm^3$/g to about 20 G·$cm^3$/g.

14. The drill bit of claim 1 wherein the cemented carbide substrate exhibits corrosion pits having an average width of about 0.5 μm to about 2.5 μm after immersing the cemented carbide substrate in 10% hydrochloric acid for about 24 hours.

15. The drill bit of claim 1, wherein the tungsten carbide grains exhibit abnormal grain growth include about 5% or less of a total surface area of the interfacial surface.

16. The drill bit of claim 1 wherein the tungsten carbide grains exhibit abnormal grain growth include greater than 0% to about 5% or less of a total surface area of the interfacial surface, the tungsten carbide grains exhibiting abnormal grain growth exhibit an average length of about 8 μm to about 15 μm.

17. The drill bit of claim 1 wherein the drill bit is a fixed cutter drill bit.

18. The drill bit of claim 1 wherein the drill bit is a core bit, roller-cone bit, eccentric bit, or bicenter bit.

19. A rotary drill bit, comprising:

a bit body configured to facilitate drilling a subterranean formation, the bit body including blades; and a plurality of cutting elements mounted to the blades, at least one of the plurality of cutting elements including:

a cemented carbide substrate including a cobalt-containing cementing constituent cementing a plurality of tungsten carbide grains together, the plurality of tungsten carbide grains exhibiting an average grain size of about 0.8 μm to about 1.5 μm, the cemented carbide substrate including an interfacial surface and a depletion zone that extends inwardly from an interfacial surface thereof to a depth of about 30 μm to about 50 μm, the depletion zone exhibiting a Palmquist fracture toughness of about 6 MPa·$m^{0.5}$ to about 9 MPa·$^{0.5}$, wherein the cemented carbide substrate excludes chromium; and a polycrystalline diamond table bonded to the interfacial surface of the cemented carbide substrate, the polycrystalline diamond table including a plurality of diamond grains bonded together and defining a plurality of interstitial regions, the plurality of the diamond grains exhibiting an average grain size of about 40 μm or less, at least a portion of the polycrystalline diamond able including a metallic constituent disposed in at least a portion of the plurality of interstitial regions, the metallic constituent of the at least a portion of the polycrystalline diamond table is present in an amount of about 7.5 weight % or less, the at least a portion of the polycrystalline diamond table exhibiting a coercivity of about 130 Oe to about 250 Oe and a specific magnetic saturation of about 5 G·$cm^3$/g to about 15 G·$cm^3$/g.

20. A drill bit, comprising:

a bit body configured to facilitate drilling a subterranean formation, the bit body including blades; and a plurality of cutting elements mounted to the blades, at least one of the plurality of cutting elements including:

a single cemented carbide substrate including a cobalt-containing cementing constituent cementing a plurality of tungsten carbide grains together, the plurality of tungsten carbide grains exhibiting an average grain size of about 1 μm to about 1.5 μm, the single cemented carbide substrate including an interfacial surface and a depletion zone that extends inwardly from an interfacial surface thereof to a depth of about 30 μm to 50 μm, the depletion zone exhibiting a Palmquist fracture toughness of about 6 MPa·$m^{0.5}$ to about 9 MPa·$m^{0.5}$, wherein the single cemented carbide substrate:

excludes chromium; and exhibits a transverse rupture strength of about 460 ksi to about 550 ksi, a hardness of about 89.5 HRa to about 92 HRa, a coercivity of about 130 to about 150 Oe, a magnetic saturation of about 10 G·$cm^3$/g to about 20 G·$cm^3$/g, and corrosion pits having an average width of about 0.5 μm to about 2.5 μm after immersing the single cemented carbide substrate in 10% hydrochloric acid for about 24 hours; and a polycrystalline diamond table bonded to the interfacial surface of the single cemented carbide substrate, the polycrystalline diamond table including a plurality of diamond grains bonded together and defining a plurality of interstitial regions, the plurality of the diamond grains exhibiting an average grain size of about 40 μm or less, at least a portion of the polycrystalline diamond able including a metallic constituent disposed in at least a portion of the plurality of interstitial regions, the metallic constituent of the at least a portion of the polycrystalline diamond table is present in an amount of about 7.5 weight % or less, the at least a portion of the polycrystalline diamond table exhibiting a coercivity of about 115 Oersteds ("Oe") to about 250 Oe and a specific magnetic saturation of about 15 Gauss·$cm^3$/grams or less.

* * * * *